US005600359A

United States Patent [19]

Kikuchi

[11] Patent Number: 5,600,359

[45] Date of Patent: Feb. 4, 1997

[54] THERMAL TRANSFER PRINTING METHOD AND APPARATUS

[75] Inventor: Shuichi Kikuchi, Miyagi, Japan

[73] Assignee: Sony Corporation, Japan

[21] Appl. No.: 440,140

[22] Filed: May 12, 1995

Related U.S. Application Data

[63] Continuation-in-part of Ser. No. 272,004, Jul. 8, 1994, abandoned.

[30] Foreign Application Priority Data

Jul. 14, 1993 [JP] Japan ..... 5-195565
May 12, 1994 [JP] Japan ..... 6-098497

[51] Int. Cl.[6] ..... B41J 2/325; B41F 16/00

[52] U.S. Cl. ..... 347/171; 156/230; 156/239; 156/240; 156/282

[58] Field of Search ..... 347/171; 156/230, 156/239, 240, 277, 282, 349, 384, 385, 387

[56] References Cited

U.S. PATENT DOCUMENTS 4,352,721 10/1982 Park et al. ..... 156/240
4,764,177 8/1988 Sumi et al. ..... 156/230

FOREIGN PATENT DOCUMENTS 4-176759 11/1993 Japan ..... 347/171

*Primary Examiner*—Huan H. Tran
*Attorney, Agent, or Firm*—Ronald P. Kananen

[57] ABSTRACT

A method and apparatus for thermal transfer of a picture pattern or a letter on a printing surface of a material formed of metal or ceramics exhibiting high heat dissipating properties. The thermal transfer apparatus, by which the thermal transfer method may be carried out, includes a holding unit for holding the material and having a heater for heating the material, a thermal transfer head for heating the thermal transfer film for transferring the printing layer onto the material, a cooling unit for cooling the thermal transfer film, a peeling unit for peeling the base film of the thermal transfer film, and a control unit for pressing the thermal transfer head against the thermal transfer film as the material is heated by the heater for transferring the printing layer onto the material. The control unit causes the thermal transfer film to be cooled by the cooling means after separation of the thermal transfer head from the thermal transfer film. The control unit also causes the peeling unit to peel the base film off from the material.

8 Claims, 18 Drawing Sheets

THERMAL TRANSFER PRINTING METHOD AND APPARATUS

This application is a continuation-in-part of U.S. application Ser. No. 08/272,004, filed Jul. 8, 1994, now abandoned.

BACKGROUND OF THE INVENTION

1. Field of the Invention

This invention relates to a method and apparatus for thermal transfer printing for thermal transfer of an object, such as a picture pattern or a letter formed on a thermal transfer film, onto a printing surface of a support of metal or ceramics having high heat dissipating characteristics.

2. Description of Related Art

A disc-shaped recording medium, such as a floppy disc, a magnetic disc or a magneto-optical disc, is rotatably accommodated in a cartridge main body, combined from an upper cartridge half 2 and a lower cartridge half 3, to constitute a disc cartridge, as shown for example in FIG. 1. By enclosing a disc-shaped recording medium 4 in the cartridge main body in a sealed manner, the surface of the disc-shaped recording medium 4 may be protected against possible grazing or deposition of foreign matter, such as dust and dirt.

The cartridge main body has an information signal recording/reproducing aperture for exposing a part of a signal region of the disc-shaped recording medium 4 to outside across the inner and outer rims of the signal region of the recording medium 4. In order to prevent dust and dirt from entering and becoming deposited on the surface of the disc-shaped recording medium 4, the information signal recording/reproducing aperture is closed, during the time the disc cartridge is not in use, by a shutter member 5 movable along a lateral side of the cartridge main body 1. The shutter member 5 is formed by punching and bending a thin metal plate and is comprised of a pair of shutter sections for opening and closing the information signal recording/reproducing aperture, and a connecting web section interconnecting proximal sides of the shutter sections.

The shutter member 5 has the name of the producer, kind or type of the article and the model name 6, printed on the surface of one of the shutter sections. The names of the producer, kind or type of the article or the model name 6, mainly provided from a functional aspect, have hitherto been formed by a direct printing method, such as a silk screen printing method or a pad printing method. Recently, disc cartridges are processed decoratively for distinction from peer products. That is, the name of the producer, kind of the article and the model name 6 are printed on the shutter member 5 in multiple colors, while a picture pattern 7 indicating the contents of the information signals recorded on the disc-shaped recording medium 4 is also printed on the shutter member 5.

On the other hand, industrial ceramics, excellent in heat resistance or resistance against impact or abrasion, are employed in products of various sectors. These ceramic products are also frequently supplied as components and the name of the producer, kind of the article or the model number is printed by the direct printing method, such as a silk screen printing or pad printing, from functional aspects.

Meanwhile, the direct printing method, such as the silk printing method or the pad printing method, employed for printing on a metal or ceramic product, such as the above-mentioned shutter member for the disc cartridge, necessitates a large number of plates corresponding to the number of colors which are to be in use, so that printing accuracy is lowered due to shifting of the plate position, resulting in an increased number of printing steps and cost. Consequently, the number of colors employed in multicolor printing on metal or ceramic products cannot practically be increased to more than two at most. With such a small number of colors, decorative printing, which distinguishes the product from peer products, cannot be expected.

In order to solve the above-mentioned problem inherent in the direct printing method, it is contemplated to employ a thermal transfer printing method employing a thermal transfer film 10, as shown for example in FIG. 2. A thermal transfer film 10 comprises a base film 11, formed of, for example, polyester or polyolefin, and having a transparent release layer (protective layer) 12 of vinyl chloride or a vinyl acetate copolymer formed thereon. A printing layer 13, carrying a letter or a picture pattern thereon, is formed by printing on the release layer 12, and a heat-sensitive adhesive layer 14 is formed for sheathing the printing layer 13.

Consequently, if, after applying the thermal transfer film 10 on the printing surface of a support (e.g., shutter member 5), the thermal transfer film 10 is pressed onto the support by a thermal transfer head, the heat-sensitive adhesive layer 14 is melted so that the printing layer 13 and the release layer 12 are transferred onto the support. The letter or the picture pattern, formed on the thermal transfer film 10, is printed by releasing the base film 11 and leaving the printing layer 13 and adhesive layer 14 on the printing surface. This process is shown sequentially in FIGS. 2 to 5.

The thermal transfer printing method, employing the thermal transfer film 10, enables multicolor letters or picture patterns to be printed on the support in a simpler manner, and hence may be advantageously applied to products or components which are in need of decorative processing and must be produced at low cost.

Although the thermal transfer printing is highly effective for multicolor printing, heat dissipation from the thermal transfer head occurs from the ceramic product or the metal product having high heat radiation characteristics, with the result that the melting temperature of the heat-sensitive adhesive layer 14 of the thermal transfer film 10 is hardly reached. As a result, the letter or the picture pattern formed on the thermal transfer film 10 is partially left on the thermal transfer film 10 without being transferred in an optimum state to the support, such as the metal product or the ceramic product. On the other hand, the heating time for heating the thermal transfer film 10 is protracted, thereby lowering the printing efficiency.

For overcoming these problems, it may be contemplated to set the temperature of the thermal transfer head to a higher temperature and to press the thermal transfer film 10 at a higher temperature. However, if the thermal transfer film 10 is heated to too high a temperature, the printing layer 13 formed thereon tends to be destroyed. Consequently, the thermal transfer printing method, which is universally employed for products having low heat radiating (i.e., heat dissipating) characteristics, such as products of synthetic resin or porcelain, cannot be applied without considerable difficulties to the printing of letters or picture patterns on the surface of metal or ceramic products having high heat radiation characteristics. Therefore, there has been little application of multicolor printing on these products.

SUMMARY OF THE INVENTION

It is a principal object of the present invention to provide a method and apparatus for thermal transfer printing which resolves the above inconveniences.

It is a further object of the present invention to provide a method and apparatus for thermal transfer printing according to which a letter, a picture pattern, a multicolor picture pattern or the like may be transfer printed via a thermal transfer film on a printing surface of a transfer printing article formed of metal or ceramics exhibiting high heat-dissipating characteristics in a short time in a satisfactory printing state.

According to the present invention, there is provided a thermal transfer printing apparatus for transferring a printing layer from a thermal transfer film onto a metal or ceramic support material by a thermal transfer head. The thermal transfer film is formed along with a heat sensitive adhesive layer on a base film of the thermal transfer film. There is provided holding means for holding the support material and having a heater for heating the support material. There is also provided a thermal transfer head for heating the thermal transfer film for transferring the printing layer onto the support material as well as cooling means for cooling the thermal transfer film and peeling means for peeling the base film of the thermal transfer film. There is additionally provided control means for pressing the thermal transfer film by the thermal transfer head as the support material is heated by the heater for thrusting the thermal transfer film onto the holding means for transferring the printing layer onto the support material. The control means causes the thermal transfer film to be cooled by the cooling means after separation of the thermal transfer head from the thermal transfer film. The control means also causes the peeling means to peel the base film off from the support material.

With the thermal transfer device according to the present invention, the base film of the thermal transfer film is peeled off from one side of the support material. In first and second embodiments, a control means causes the base film of the thermal transfer film to be peeled off from the support material by shifting the thermal transfer film upward and by shifting the holding member holding the support material. In the first embodiment, the holding member is shifted in a direction opposite the take-up direction of the base film, and in the second embodiment, the holding member is shifted in a direction substantially at right angles to the take-up direction.

In a third embodiment of the present invention, a preliminary heating roll is used to pre-heat the shutter member.

In a fourth embodiment of the present invention, a wedge-shaped peeling member is rotatably mounted for controlled movement between the shutter member and the thermal transfer film.

In a fifth embodiment of the present invention, the thermal transfer printing device is arranged on a rotary table to perform continuous thermal transfer printing using a series of operating steps.

In a sixth embodiment of the present invention, a plurality of fixed film peeling members are used in conjunction with a movable shutter holding member. The shutter holding member is movable relative to the fixed peeling members to separate the base film from the shutter member.

BRIEF DESCRIPTION OF THE DRAWINGS

The accompanying drawings, which are incorporated in, and form a part of, the specification, illustrate preferred embodiments of the present invention and, together with the description, serve to explain the principles of the invention. In the drawings:

FIGS. 22(A) to 22(C) illustrate the operation of the film peeling member of the thermal transfer printing device peeling the base film of the thermal transfer film from the shutter member after thermal transfer printing on the shutter member, wherein FIG. 22(A) shows the state of termination of the thermal transfer printing, FIG. 22(B) shows the base film being peeled off, and FIG. 22(C) shows the base film having been peeled from the shutter member.

DESCRIPTION OF THE INVENTION

Figure 1:
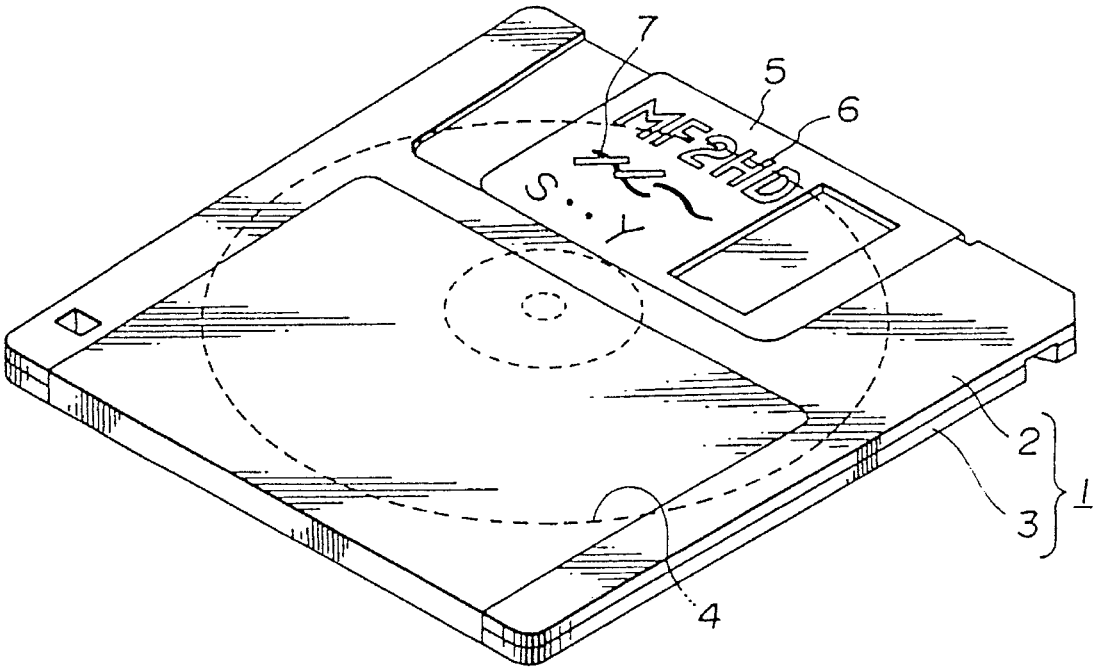
FIG. 1 is a perspective view of a disc cartridge having a shutter member shown as an example of a support.
Figure 2:
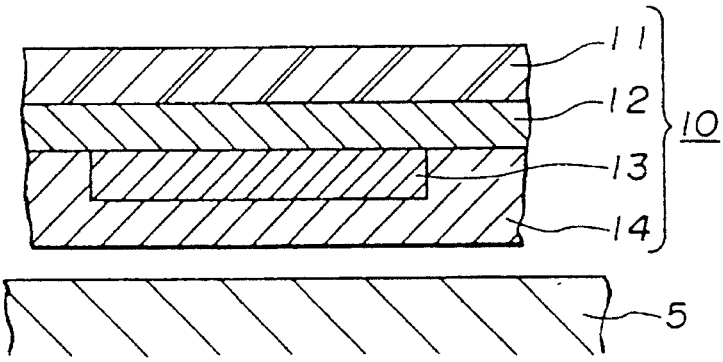
FIG. 2 is a schematic cross-sectional view of a thermal transfer film.
Figure 3:
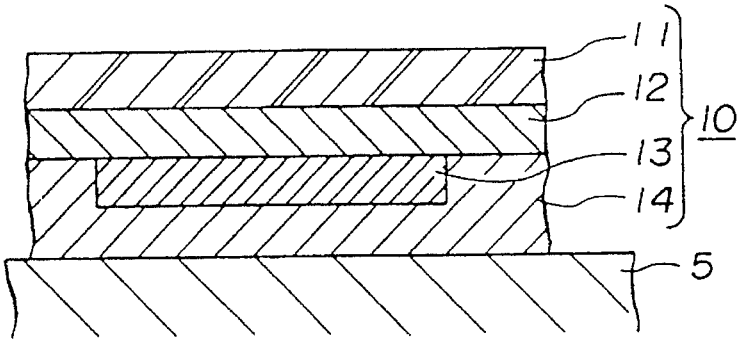
FIG. 3 is a schematic cross-sectional view for illustrating the transfer printing operation by the thermal transfer printing device, showing the thermal transfer film being pressed under heating against the support.

Referring to the drawings, preferred embodiments of the present invention will now be explained in detail.

A thermal transfer printing device 30 according to a first embodiment of the present invention is used for multicolor printing of a letter 6 or a picture pattern 7, indicating the name of a producer, article type or a model number, on one of the shutter sections of the shutter member 5 prepared by punching and bending a thin stainless steel plate into a U-shape.

Referring to FIGS. 6 to 10 the thermal transfer printing device 30 comprises a thermal transfer head driving unit 31, constituted by a pneumatically or hydraulically driven vertical type press device, a thermal transfer head 40 mounted on the distal end of the driving unit 31, a thermal transfer film cooling unit 50 and a heater controller 55, both provided in a main body member of the driving unit 31, a shutter holding member 60 holding the shutter member 5 for constituting a support holding unit, and a thermal transfer film supply guide unit 70 for supplying the roll-shaped thermal transfer film 10 to the thermal transfer head driving unit 31.

Figure 7:
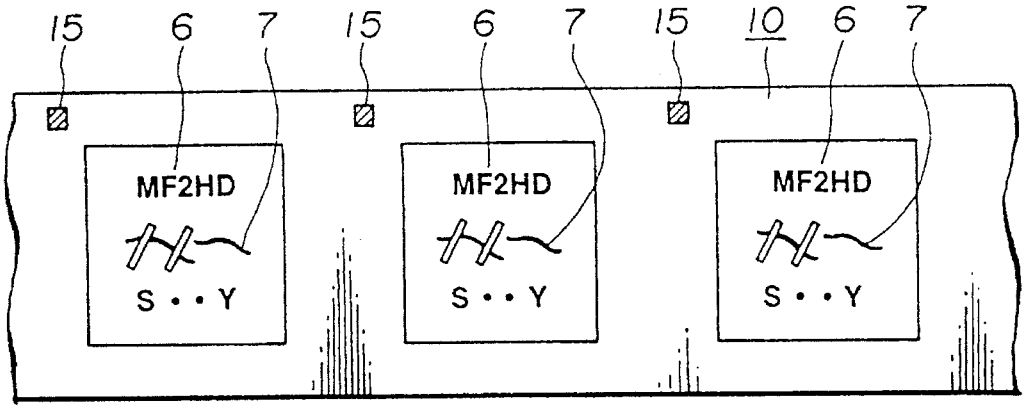
FIG. 7 shows a roll-shaped thermal transfer film employed in the thermal transfer device.
Figure 8:
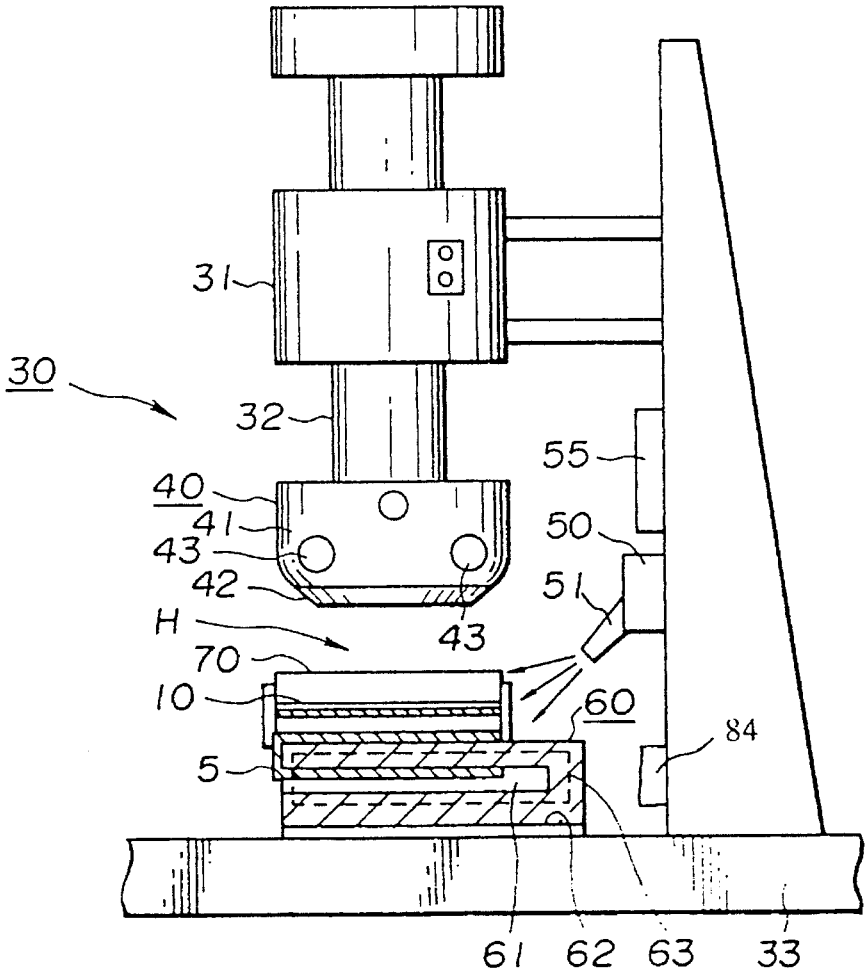
FIG. 8 is a side view of the thermal transfer printing device, partially broken away.

The thermal transfer film 10 is formed as an elongated tape having continuously formed thereon the name of the producer, article name and the model number 6 and the picture pattern 7 in multicolor printing, and a marker 15 applied in association with each printing area, as shown in FIG. 7. The thermal transfer film 10 is positioned with respect to the shutter member 5 which is which is held by the holding member 60, in accordance with a position sensor 75 which is provided between a supply reel 71 and a first guide reel 73A detecting a marker 15. When the press device 31 is actuated for lowering a thermal transfer head 40, the thermal transfer film 10 is pressed under heating onto the surface of one of the shutter sections of the shutter member 5.

The shutter member 5 is pre-heated to a predetermined temperature by an enclosed heater 63 within the holding member 60. This prevents heat of the thermal transfer head 40 from being dissipated from the shutter member 5 when the thermal transfer head 40 presses the thermal transfer film 10 under heating against the shutter member 5. The heat sensitive adhesive layer 14 of the transfer film 10 thus reaches its melting temperature promptly so as to be positively transferred onto the shutter member 5 along with the protective layer 12 and the printing layer 13 having the name of the producer, article name and the model number 6 and the picture pattern 7 printed therein with multiple color.

The thermal transfer head driving unit 31 pneumatically or hydraulically actuates the ram 32, in other words, the thermal transfer head 40, in a vertical direction. The thermal transfer head 40, driven by the thermal transfer head driving unit 31, includes a main body member 41, having its lower surface swollen downward at a mid-portion thereof so as to be formed as an arcuate surface, and a heat-resistant elastic member 42 secured to the arcuate lower surface of the main body member 41. The main body member 41 has enclosed therein a heater 43 which controls the temperature of the main body member 41 by the heater controller 55 to a pre-set temperature, such as 170° C. The elastic member 42 is formed by silicon rubber having a Shore rubber hardness on the order of 70. The elastic member 42 has an increased thickness at a mid-portion thereof so that the radius of curvature at the mid-portion is larger than the radius of curvature of the mid-portion of the arcuate surface of the main body member 41. Thus, the thermal transfer head 40 has an arcuate head surface as shown.

The vertical press device constituting the thermal transfer head driving unit 31 has a head 33 as a portion of a transporting passage of the thermal transfer printing device 30. The shutter holding member 60 is moved along the transporting passage. The shutter holding member 60 is formed of high heat conductive metal in the shape of a box having a hollow portion 61. A heat insulating sheet 62 is bonded to the bottom surface of the shutter holding member 60 and heaters 63, 63 are enclosed on both lateral sides delimiting the hollow portion 61. These heaters 63 control the temperature of the shutter holding member 60 to, for example, 100° C. by a heater controller 84. The heat insulating sheet 62 prevents heat of the heaters 63 of the shutter holding member 60 from being dissipated towards the head 33.

The thickness of the upper surface and the hollow portion 61 of the shutter holding member 60 is substantially equal to the height of the connecting web portion of the shutter member 5, while the width of the hollow portion 61 is substantially equal to the width of the shutter section of the shutter member 5. Thus, each of a number of the shutter members 5 may be inserted into and held by an associated shutter holding member 60 in a previous stage by having one of the shutter sections slid along the upper surface of the shutter holding member 60 and the other shutter member inserted into the hollow portion 61. The shutter member 5, thus loaded into and held by the shutter holding member 60, has the major surface of the upper side shutter section as a printing surface.

With the above-described thermal transfer printing device 30, the shutter member 5 is loaded into and held by the shutter holding member 60, and the shutter holding member 60 is adapted to be transported along the transporting passage for performing automatic printing. However, it is also possible to arrange the shutter holding member 60 in a fixed manner at a preset position of the head 33 of the vertical press unit constituting the thermal transfer head driving unit 31, that is at a position registering with the center axis of the thermal transfer head 40, for performing thermal transfer printing on the printing surface of the shutter member 5, referred to herein as a thermal transfer printing position H, and to load the shutter member 5 in the hollow portion 61 of the shutter holding member 60 in order to effect thermal transfer printing.

It is noted that, if the shutter member 5 is preheated by the heater 63 enclosed in the holding member 60, it prolongs the time until solidification of the heat sensitive adhesive layer 14 due to the redundant heat of the shutter member 5. Thus a problem is raised that, unless sufficient cooling time is allowed, the printing layer 13 is not released completely from the base film 11, thereby lowering printing accuracy.

For this reason, there is provided a thermal transfer film cooling unit 50. The shutter holding members 60, each having the shutter member 5 loaded and held thereon, are transported by a transporting unit 82 at a pre-set interval from one another on the transporting passage as far as a thermal transfer printing position H registering with the thermal transfer head driving unit 31. The thermal transfer film cooling unit 50 provided on a main body member of the thermal transfer head driving unit 31 includes an intermittently actuated cooling fan (not shown) and is operatively linked to the upward movement of the thermal transfer head 40 (as later explained) for blowing air from a nozzle 51 towards the shutter member 5 loaded and held by the shutter holding member 60 which has now been transported to the thermal transfer printing position.

The thermal transfer film supply guide unit 70 includes a supply reel 71 for supplying the roll-shaped thermal transfer film 10 to the thermal transfer head driving unit 31, a take-up reel 72 for taking up the base film 11 of the thermal transfer film 10 from which the printed letters 6 or the picture patterns 7 have been transferred onto the shutter member 5 by the thermal transfer head driving unit 31, a pair of thermal transfer film guide members 73, 74, a positioning sensor 75 for reading the markers 15 associated with the letters 6 or the picture patterns 7 printed on the thermal transfer film 10, and a pair of pinch rolls 76.

The supply reel 71 and the take-up reel 72 are rotated intermittently in synchronism with each other by a driving source (not shown) for supplying the thermal transfer film 10 in a taut manner to the thermal transfer head driving unit 31. The positioning sensor 75 reads the marker 15 provided on the thermal transfer film 10 for controlling the driving source for the supply reel 71 and the take-up reel 72 so that the thermal transfer film 10 is stopped with the printing layer 13 carrying the letter 6 or the picture pattern 7 thereon being in register with the thermal transfer printing position H. The intermittent rotation of the supply reel 71 and the take-up reel 72 is carried out in synchronism with the upward movement of the thermal transfer head 40 for supplying the-thermal transfer film 10 by pre-set lengths to the thermal transfer printing position H.

The thermal transfer film guide members 73, 74 are arranged on both sides of the thermal transfer printing position H, and are made up of guide rolls 73A, 74A, rotatably supported by supporting shafts 73B, 74B, respectively, and guide brackets 73C, 74C, adapted to be rotated and vertically moved by a driving source (not shown). The guide brackets 73C, 74C are substantially wedge-shaped and each have a major surface serving as a rest surface along which is slid the thermal transfer film 10.

Figure 6:
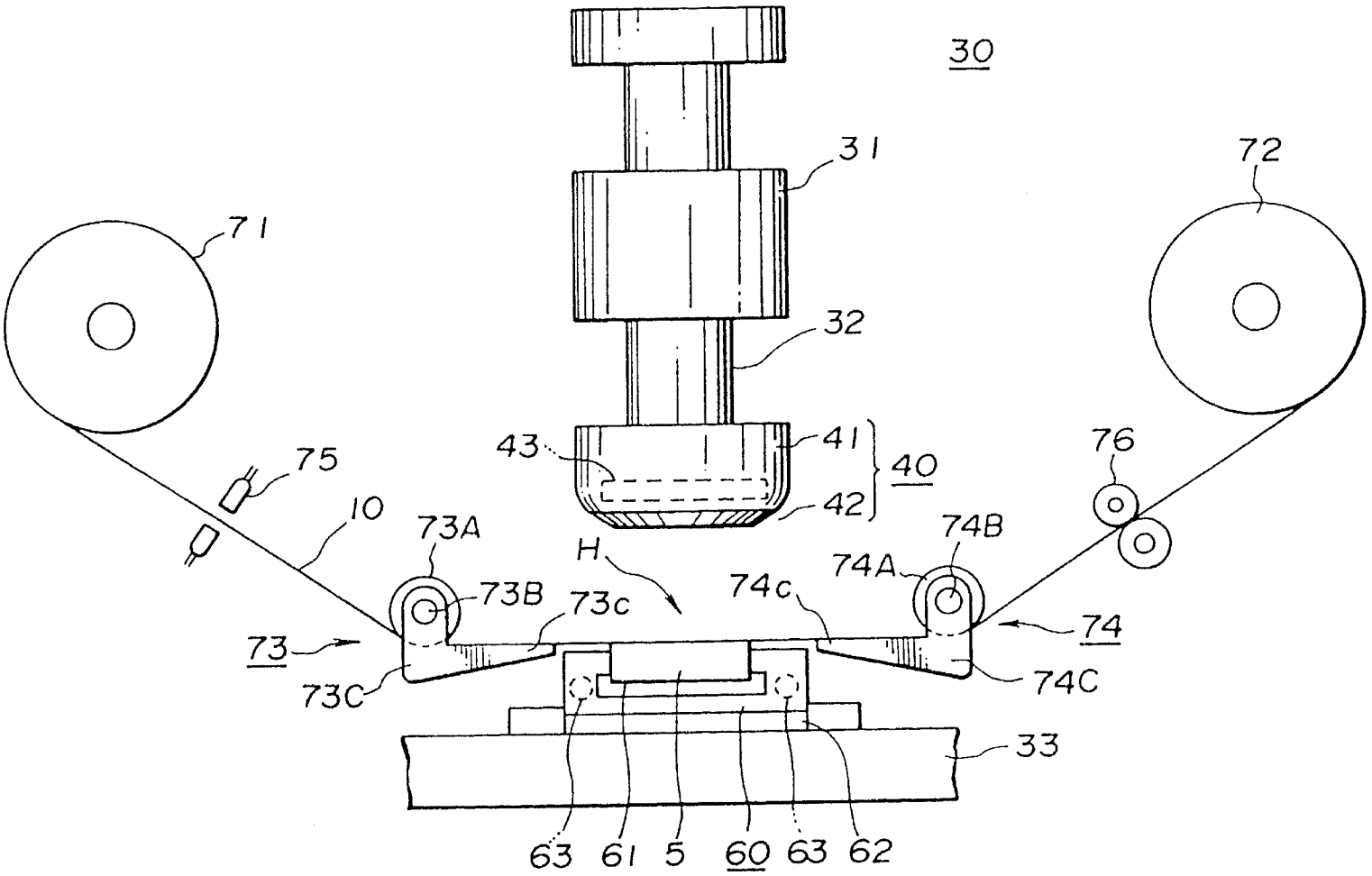
FIG. 6 is a schematic front view showing a thermal transfer printing device according to the present invention.

These guide brackets 73C, 74C are formed as one with arm sections opposite to the thermal transfer printing position H for supporting the supporting shafts 73B, 74B, respectively. These supporting shafts 73B, 74B also act as rotation supporting shafts for the guide brackets 73C, 74C, respectively. When the thermal transfer film guide members 73, 74 are at the lower positions, the guide brackets 73C, 74C have their free ends 73*c*, 74*c* positioned in proximity to both longitudinal sides of the shutter holding member 60 transported to the thermal transfer printing position H, while the major surfaces of the guide brackets 73C, 74C are substantially flush with the printing surface of the shutter member 5 loaded on the shutter holding member 60, as shown in FIG. 6. Thus the thermal transfer film 10, reeled out from the supply reel 71, is guided in a horizontal position by the guide roll 73A of the first thermal transfer film guide member 73 and the guide roll 74A of the second thermal transfer film guide member 74, as the film 10 is lightly contacted with the printing surface of the shutter member 5 disposed at the thermal transfer printing position H, until the film 10 is taken up by the take-up reel 72.

Figure 9:
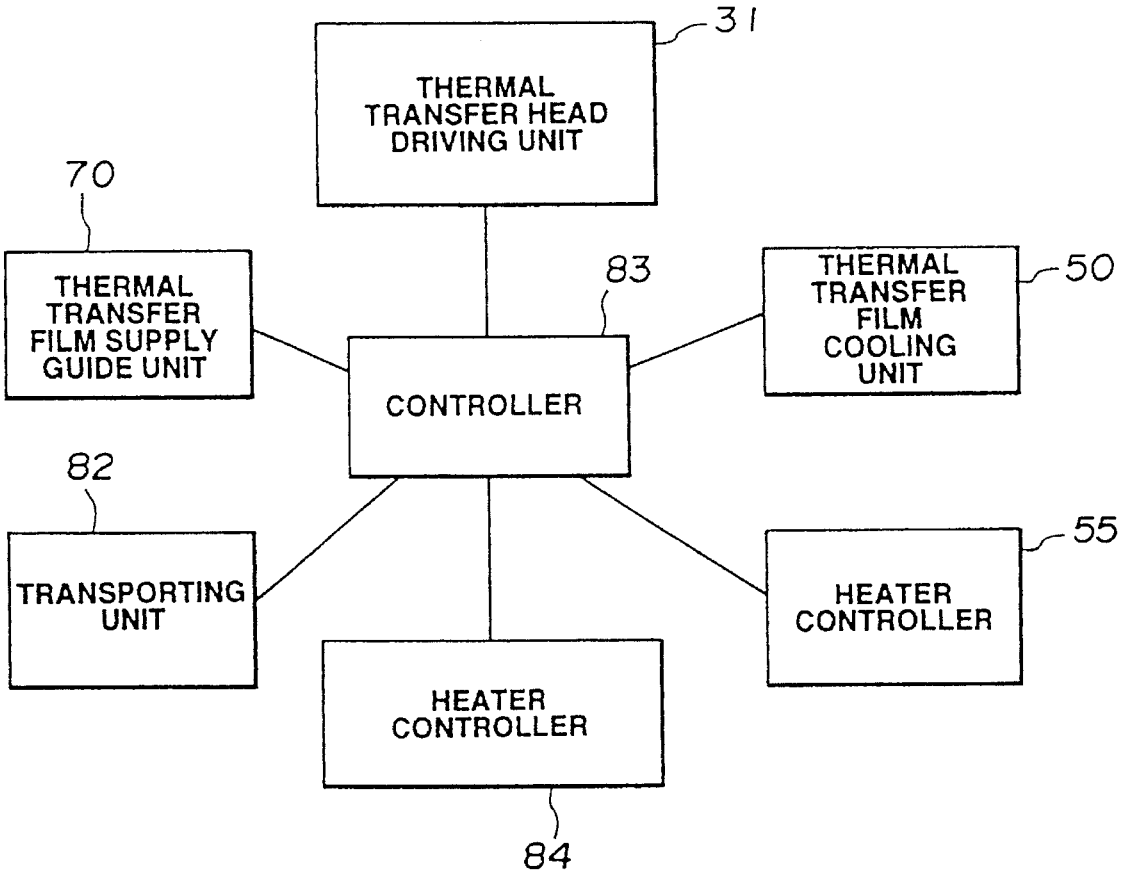
FIG. 9 is a block diagram showing a control system for the thermal transfer printing device.

FIG. 9 shows a control system for the above-described thermal transfer printing device 30. Referring to FIG. 9, a controller 83 controls the system in its entirety. That is, the controller 83 controls a transporting unit 82 for transporting the shutter holding members, a heater controller 84 for driving the heaters 63, 63, and the thermal transfer film cooling unit 50.

The thermal transfer printing of the letters 6 or the picture patterns 7 on the shutter member 5 of the disc cartridge by the above-described thermal transfer printing device 30 is hereinafter explained in detail. The shutter holding member 60, carrying the shutter member 5 thereon, is transported to the thermal transfer printing position H in a state in which it is pre-heated to a pre-set temperature (100° C.) by the heaters 63, 63 controlled by the heater controller 84.

When the holding member 60 is transported as far as the thermal transfer printing position H, a driving source (not shown) is actuated for lowering the thermal transfer film guide members 73, 74 for lightly applying the thermal transfer film 10 onto the printing surface of the shutter member 5 loaded onto the shutter holding member 60.

Figure 10:
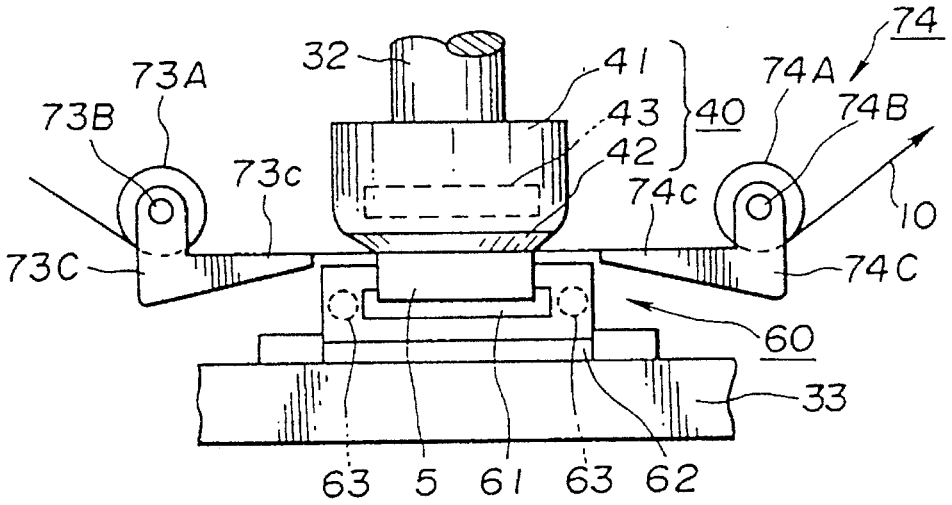
FIG. 10 is a schematic front view for illustrating the transfer printing operation by the thermal transfer printing device, showing a thermal transfer head having been lowered to a thermal transfer printing position.
Figure 11:
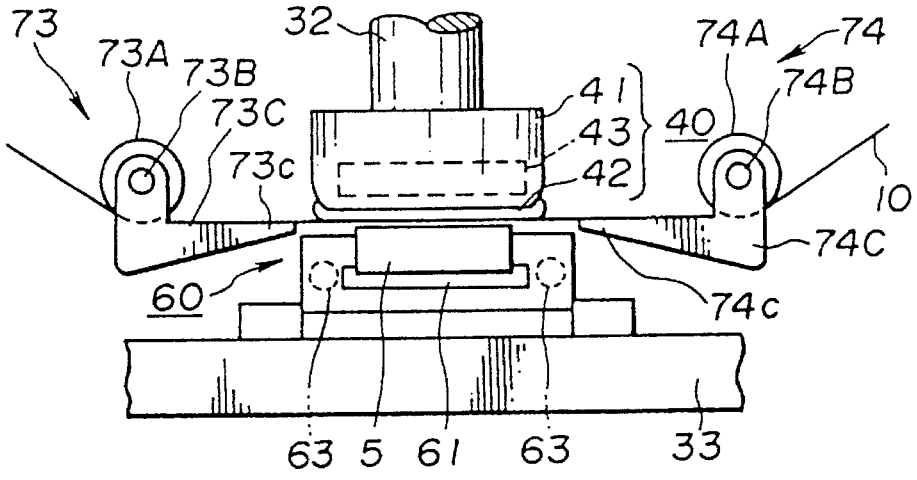
FIG. 11 is a schematic front view for illustrating the transfer printing operation by the thermal transfer printing device, showing the thermal transfer head pressing the thermal transfer film against the substrate under heating.

The thermal transfer head driving unit 31 is then actuated for lowering the thermal transfer head 40 towards the shutter member 5 loaded and held by the shutter holding member 60. Since the elastic member 42 connected to the bottom surface of the main body member 41 of the thermal transfer head 40 has the mid-portion of the bottom surface thereof swollen downward, as described previously, the elastic member presses the shutter member 5 under heating so that, as the thermal transfer head 40 is lowered, the bottom surface of the main body member 41 is gradually elastically deformed, beginning from the mid-portion and progressing towards the peripheral portion, as shown in FIGS. 10 and 11, for preventing air from being sealed between the shutter member 5 and the thermal transfer film 10.

Figure 12:
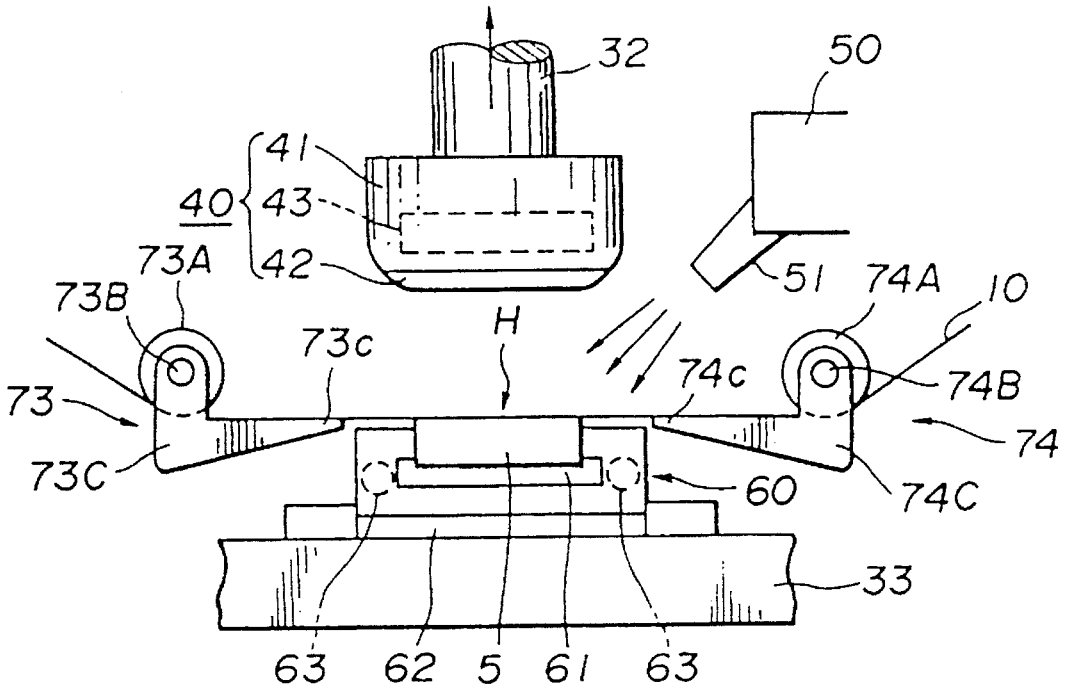
FIG. 12 is a schematic front view for illustrating the transfer printing operation by the thermal transfer printing device, showing the transfer printing operation by the thermal transfer head having come to a close and the thermal transfer film being cooled by cooling means.

The shutter member 5 is pre-heated to a predetermined temperature (100° C.) by the heaters 63, 63 enclosed within the shutter holding member 60. This preheating of the shutter member 5 eliminates the problem of the temperature state of the thermal transfer head 40 being significantly deteriorated. Thus, when the thermal transfer head 40, heated by the heater 43, is pressed against the thermal transfer film 10, the heat-sensitive adhesive layer 14 of the thermal transfer film 10 is melted in an extremely short time so as to be bonded to the shutter member 5, as shown in FIG. 11. Subsequently, the thermal transfer head driving unit 31 is actuated for shifting the thermal transfer head 40 away from the thermal transfer film 10, as shown by an arrow in FIG. 12.

As the thermal transfer head 40 is moved upward, current supply to the heaters 63, 63 enclosed within the shutter holding member 60 ceases. When the thermal transfer head 40 is raised to a pre-set position, the thermal transfer film cooling unit 50 is actuated for blowing air from the nozzle 51 towards the thermal transfer film 10. By such air blowing, the thermal transfer film 10 is rapidly lowered in temperature, despite the fact that the shutter holding member 60 is not cooled completely. Thus the heat-sensitive adhesive layer 14 transfers from the melted state to the solid state. As the heat sensitive adhesive layer 14 is hardened, the thermal transfer film 10 is bonded to the major surface of the shutter portion of the shutter member 5, so that the letter 6 or the picture pattern 7 formed on the printing layer 13 is transferred to and printed on the shutter member 5.

Figure 13:
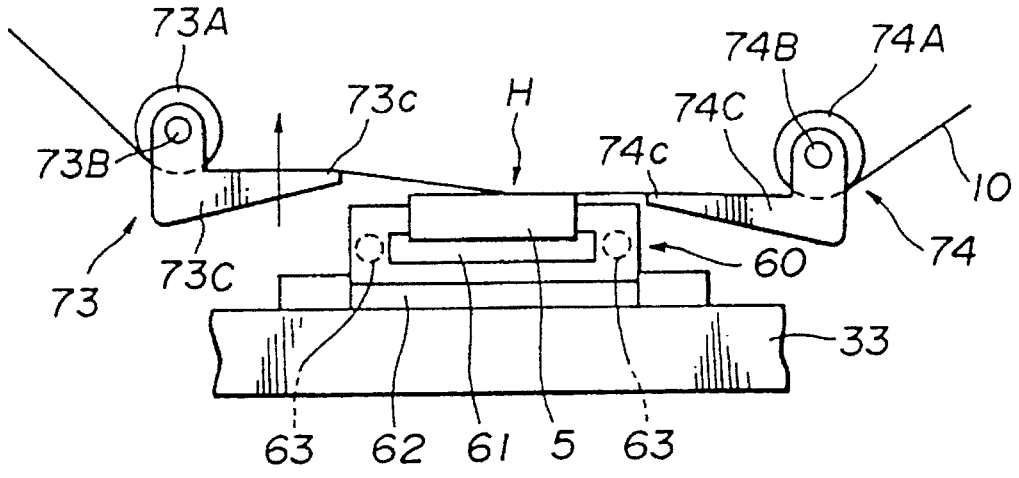
FIG. 13 is a schematic front view for illustrating the transfer printing operation by the thermal transfer printing device, showing the thermal transfer film being released and exfoliated from the support by a thermal transfer film supply guide mechanism.

On the other hand, when the thermal transfer head 40 is moved upward and air is blown from the thermal transfer film cooling unit 50 onto the thermal transfer film 10, the first thermal transfer film guide member 73 is immediately driven by a driving source (not shown). The guide bracket 73C is rotated counterclockwise, with the supporting shaft 73B as a fulcrum, as shown by an arrow in FIG. 13, so that its distal end 73*c* lifts the thermal transfer film 10 from the printing surface of the shutter member 5.

Figure 4:
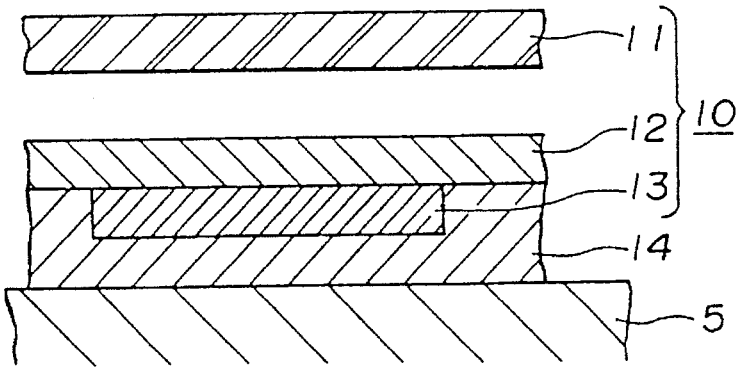
FIG. 4 is a schematic cross-sectional view for illustrating the state of a base film being released from the thermal transfer film after being pressed under heating against the support.

By such lifting movement by the free end 73*c* of the first thermal transfer film guide member 73, only the base film 11 of the thermal transfer film 10 is peeled from the printing surface of the shutter member 5, beginning from its one end portion, as shown in FIG. 4. The reason is that, if the guide reels 73A, 74A are lifted simultaneously, the shutter sections of the U-shaped shutter member 5 are deformed by being opened apart vertically by the peeling of the thermal transfer film 10. Such deformation needs to be avoided to avoid damaging the shutter members 5.

Figure 5:
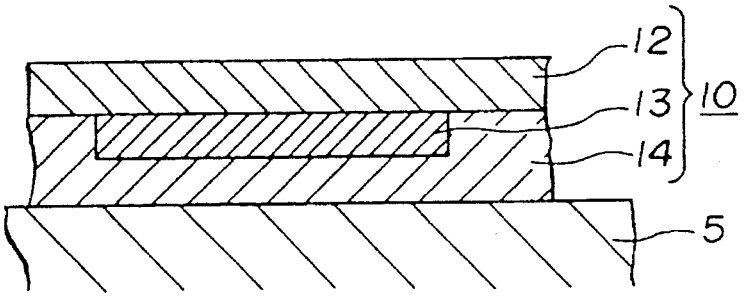
FIG. 5 is a schematic cross-sectional view for illustrating a printing layer of the thermal transfer film having been transfer printed on the support.

On the printing surface of the shutter member 5, the printing layer 13 and the protective layer 12 are transferred and printed under an optimum condition by the operation of the solidified heat sensitive adhesive layer 14, as shown in FIG. 5. Thus the letters 6 and the picture patterns 7 are formed in multiple colors on the shutter member 5.

Figure 14:
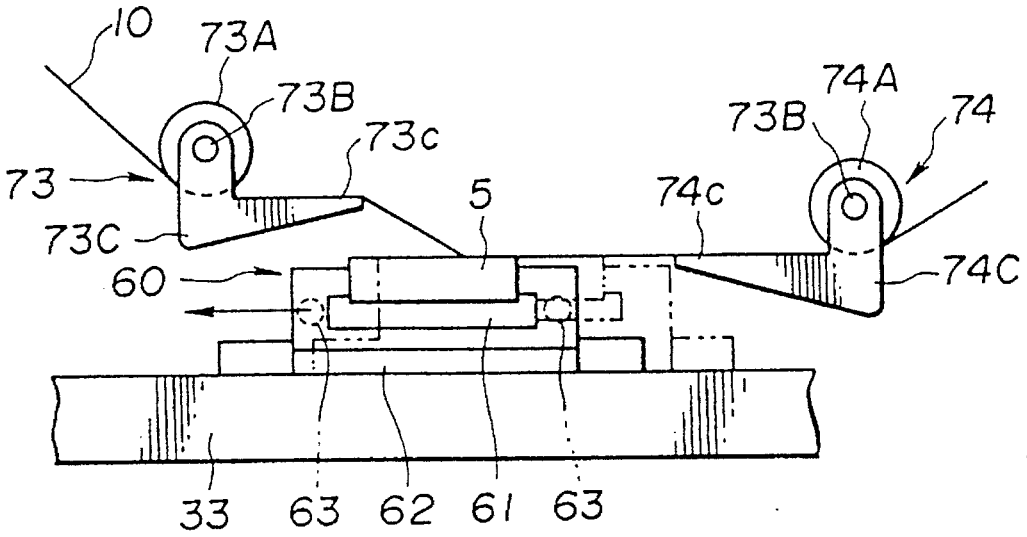
FIG. 14 is a schematic front view for illustrating the transfer printing operation by the thermal transfer printing device, showing the movement of support holding mechanism conjunctively connected to the releasing and exfoliating operation of the thermal transfer film from the support by the thermal transfer film supply guide mechanism.

The first thermal transfer film guide member 73 is further moved upward, as shown in FIG. 14, while the shutter holding member 60 is moved from the thermal transfer printing position H towards the first thermal transfer film guide member 73. As the first thermal transfer film guide member 73 and the shutter holding member 60 are moved in this manner, the thermal transfer film 10 is further peeled off from the associated side of the shutter member 5.

Figure 15:
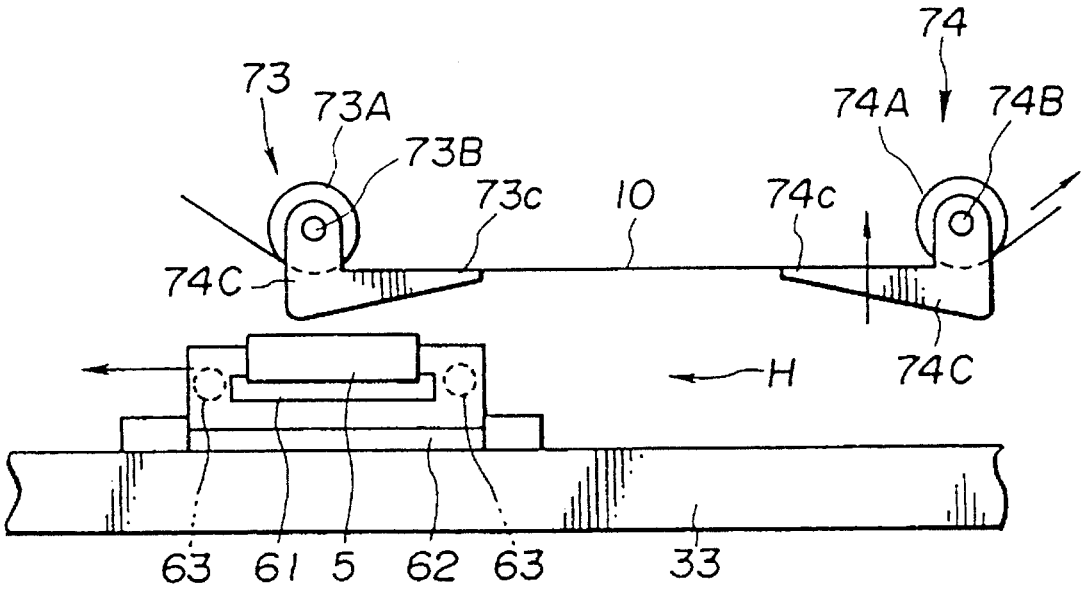
FIG. 15 is a schematic front view for illustrating the transfer printing operation by the thermal transfer printing device, showing the movement of the support holding mechanism.

Simultaneously, the second thermal transfer film guide member 74 is moved upward, as shown in FIG. 15. By the above steps, the thermal transfer printing on the shutter member is completed, and the shutter member 5 is taken out of the shutter holding member 60.

When the shutter holding member 60 is moved from the thermal transfer printing position H, the supply reel 71 and the take-up reel 72 are run in rotation so that the base film 11 having the protective layer 12, printing layer 13 and the heat sensitive layer 14 transferred thereon is moved from the thermal transfer printing position H towards the take-up reel 72, while the next printing area of the thermal transfer film 10 is supplied as far as the thermal transfer printing position H. The next shutter holding member 60 is fed on the transporting passage as far as the thermal transfer printing position H for performing continuous thermal transfer printing.

With the above-described thermal transfer printing device 30, after the pressure bonding of the thermal transfer film 10 onto the shutter member 5 by the thermal transfer head 40, and substantially simultaneously with the movement of the thermal transfer head 40, air is blown from the thermal transfer film cooling unit 50 onto the thermal transfer film 10 for accelerating solidification of the heat sensitive adhesive layer 14, so that, when the base film 11 is peeled off from the shutter member 5, part of the printing layer 13 is not left on the base film 11, such that transfer printing may be satisfactorily achieved on the printing surface of the shutter member 5. Consequently, there is no necessity of providing cooling time for the shutter holding member 60, resulting in the shorter time interval involved in the printing process.

In addition, the thermal transfer guide member 73 is driven substantially simultaneously with the blowing of the air from the thermal transfer film cooling unit 50 onto the thermal transfer film 10 for uplifting the thermal transfer film 10 for peeling it from the associated side of the shutter member 5, thus making it possible to reduce the force of peeling of the thermal transfer film 10 acting on the shutter member 5.

With the above-described thermal transfer printing device 30, the first thermal transfer film guide member 73 is actuated in advance of the second thermal transfer film guide member 74. However, the sequence of the operations may be reversed, provided that the first and second thermal transfer guide members 73, 74 acting for peeling the thermal transfer film 10 from the shutter member 5 are operated with time or speed difference so that the thermal transfer film 10 is peeled off from the associated side of the shutter member 5.

Although the thermal transfer film guide members 73, 74 are integrally formed by the guide rolls 73A, 74A for applying the thermal transfer film 10 onto the printing surface of the shutter member 5 and by the guide brackets 73C, 74C uplifting the thermal transfer film 10 from the shutter member 5 by the distal parts 73*c*, 74*c* thereof, these members may also be provided separately, while the guide rolls 73A, 74A may also be eliminated, if so desired.

Figure 16:
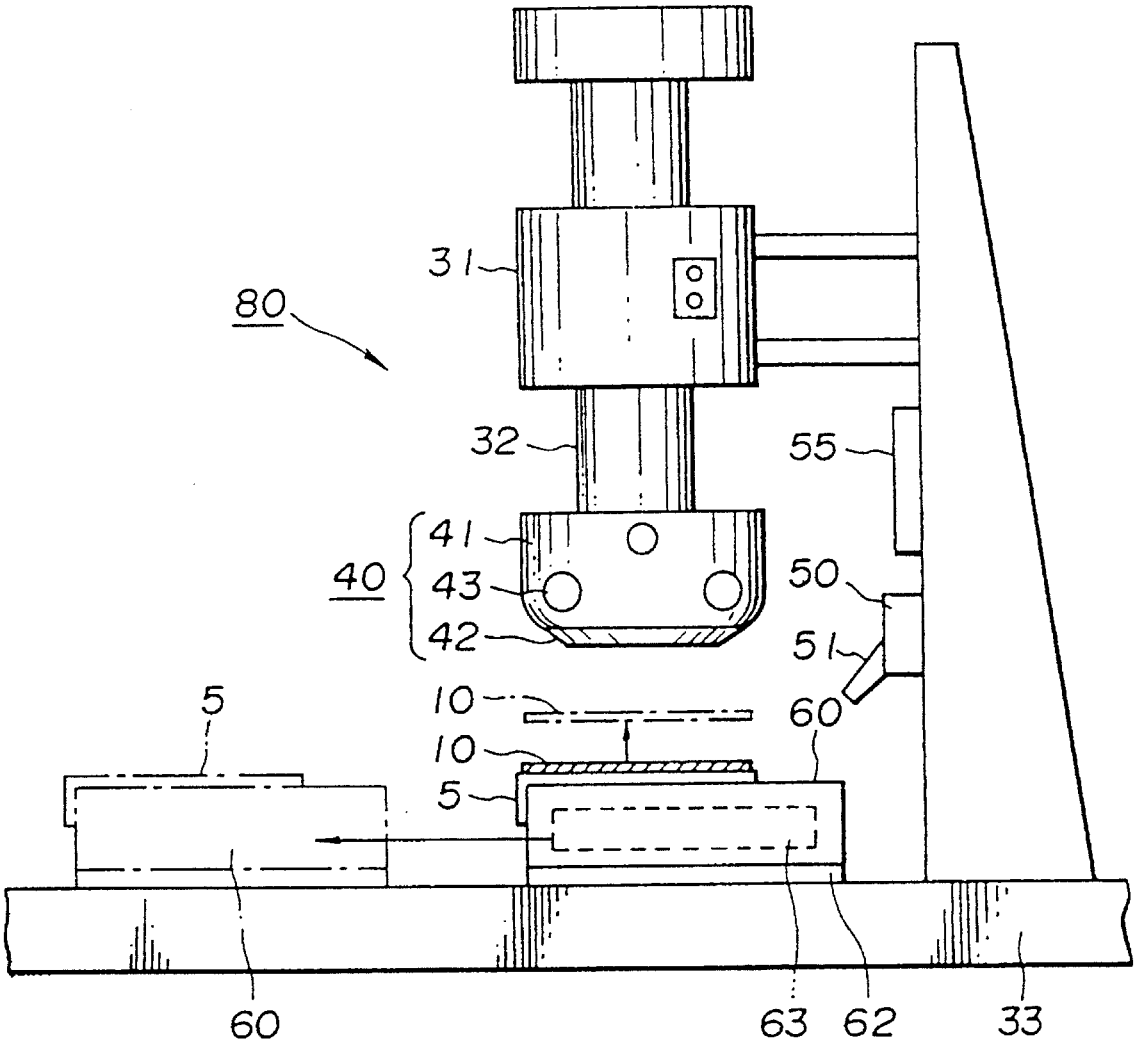
FIG. 16 is a side view showing a thermal transfer printing device according to a second embodiment of the present invention.

The arrangement of peeling off the thermal transfer film 10 from the associated side of the shutter member 5 may also be achieved by a thermal transfer printing device 80 shown in FIG. 16 by way of a second embodiment of the present invention. Since the basic construction of the second thermal transfer printing device 80 is the same as the thermal transfer printing device 30 of the first embodiment, similar parts are correspondingly numbered, and the description therefor is omitted for avoiding redundancy.

In the second embodiment, the shutter holding member 60 is moved in a direction substantially at right angles to the take-up direction of the thermal transfer film 10 away from the thermal transfer printing position H, at the same time as the thermal transfer film 10, pressure bonded to the shutter member 5 as shown by a solid line in FIG. 16, is uplifted to a dotted chain line position by lifting means.

By moving the shutter holding member 60 substantially simultaneously with the peeling of the thermal transfer film 10 by lifting away from the shutter member 5, it becomes possible to reduce the force of peeling of the thermal transfer film 10 acting on the shutter member 5 and hence to prevent deformation of the shutter member 5.

Figure 17:
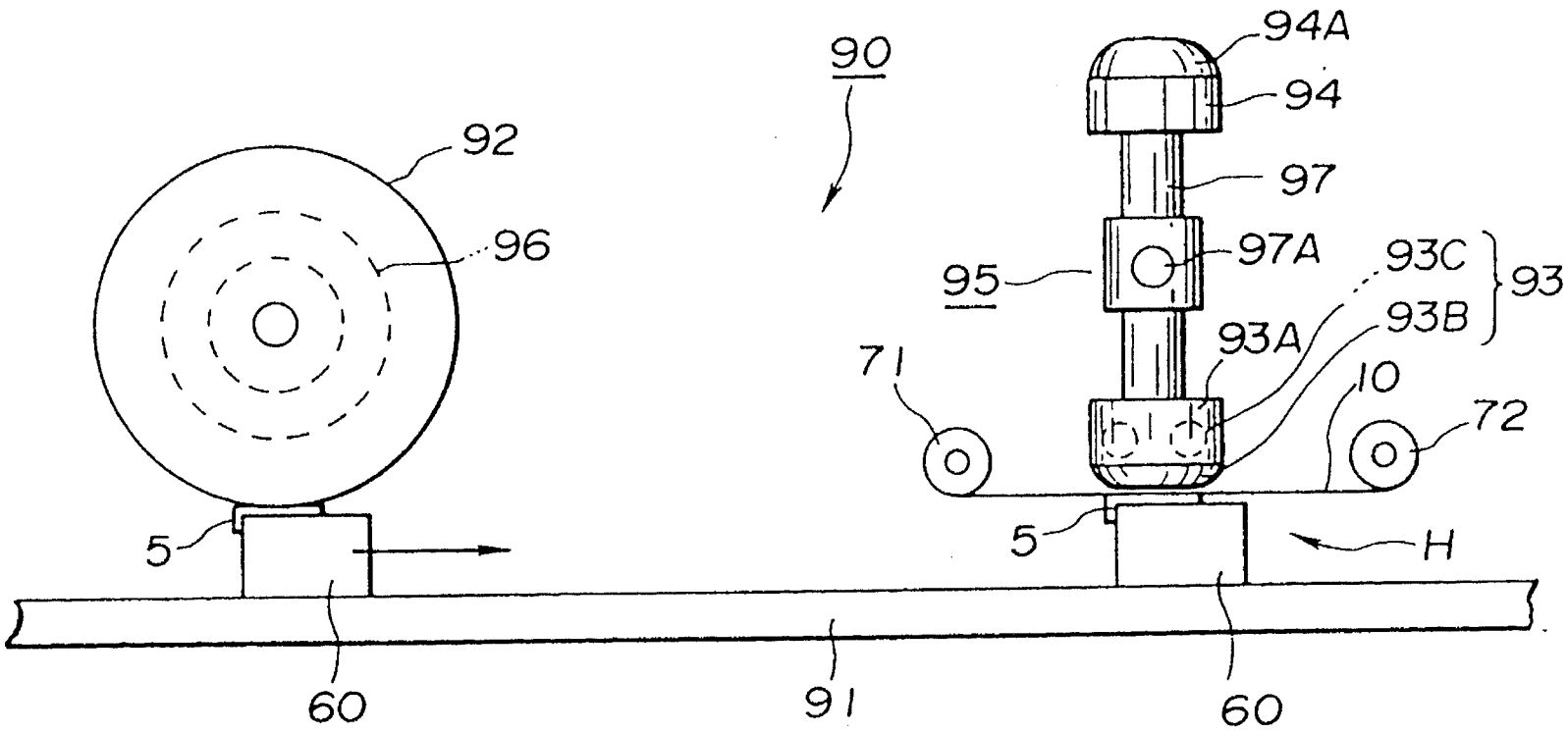
FIG. 17 is a side view showing a thermal transfer printing device according to a third embodiment of the present invention.

FIG. 17 illustrates a thermal transfer printing device 90 as a third embodiment of the present invention whereby thermal transfer printing may be achieved more efficiently. The thermal transfer printing device 90 comprises a preliminary heating roll 92 used for preheating the shutter member 5 loaded in position on the shutter holding member 60 and a head unit 95 made up of a thermal transfer head 93 and a cooling head 94. Both the heating roll 92 and the head unit 95 are provided on a transporting passage 91.

The preliminary heating roll 92, having a heater 96 enclosed therein, is provided for rotation at such a height position from a transporting passage 91 as to permit the shutter holding member 60 to travel thereunder and has its outer periphery formed of an elastic material. The shutter member 5, transported on the transporting passage 91 as it is loaded in position on the shutter holding member 60, is pre-heated to a suitable temperature as it is pressure bonded under heating onto the outer periphery of the pre-heating roll 92 and transported under such condition into the head unit 95.

The thermal transfer head 93 and the cooling head 94 of the head unit 95 are mounted via insulating means (not shown) on both ends of a ram 97 of a press unit which may be moved vertically and rotated about a center supporting shaft 97A as a fulcrum.

Similarly to the thermal transfer head of each of the above-described embodiments, the thermal transfer head 93 has a heater 93C enclosed therein, and a body member 93A with an elastic member 93B mounted on the bottom surface thereof. The cooling head 94 has its temperature set so as to be lower than that of the preheated shutter member 5 by such means as a coolant stored therein or provision of air vent holes. Similarly to thermal transfer head 93, the cooling head 94 has an elastic member 94A mounted on its bottom surface.

As for other constructional features, such as the thermal transfer film supply guide unit 70 for supplying the roll-shaped thermal transfer film 10 into the head unit 95, the present thermal transfer printing device is similar to the thermal transfer printing devices of the previous embodiments, so that similar parts are correspondingly numbered and the corresponding description is not made herein for simplicity.

With the present thermal transfer printing device 90, the shutter member 5 is pre-heated to a pre-set temperature by being caused to travel past the preliminary heating roll 92 and supplied under this condition to the thermal transfer printing position H. On the printing surface of the shutter member 5 is lightly superimposed the thermal transfer film 10 supplied from the thermal transfer film supply guide 70. The head unit 95 is then actuated for lowering the thermal transfer head 93 towards the shutter member 5 loaded on the shutter holding member 60.

As the shutter member 5 is pre-heated by the preliminary heating roll 92 to the pre-set temperature, the thermal transfer head 93, heated by the heater 93C, presses the thermal transfer film 10 onto the shutter member 5. This causes the heat-sensitive adhesive layer 14 to be melted in an extremely short time so as to be deposited on the printing surface of the shutter member 5. The head unit 95 is then actuated for displacing the thermal transfer head 93 away from the thermal transfer film 10. Simultaneously, the ram 97 is rotated about the supporting shaft 97 as the center of rotation for applying the cooling head 94 onto the thermal transfer film 10.

By the operation of the cooling head 94, the thermal transfer film 10 is suddenly lowered in its temperature for promptly solidifying the molten heat sensitive adhesive layer 14 for securely transfer printing the printing layer 13 on the printing surface of the shutter member 5. The head unit 95 is subsequently actuated for displacing the cooling head 94 away from the thermal transfer film 10. The thermal transfer film 10 is peeled off from the shutter member 5 by the partial detaching mechanism described in connection with each of the previously explained embodiments.

Referring to FIGS. 18 to 22 of the drawings, a thermal transfer printing device 100 according to a fourth embodiment of the present invention will be explained in detail.

Figure 18:
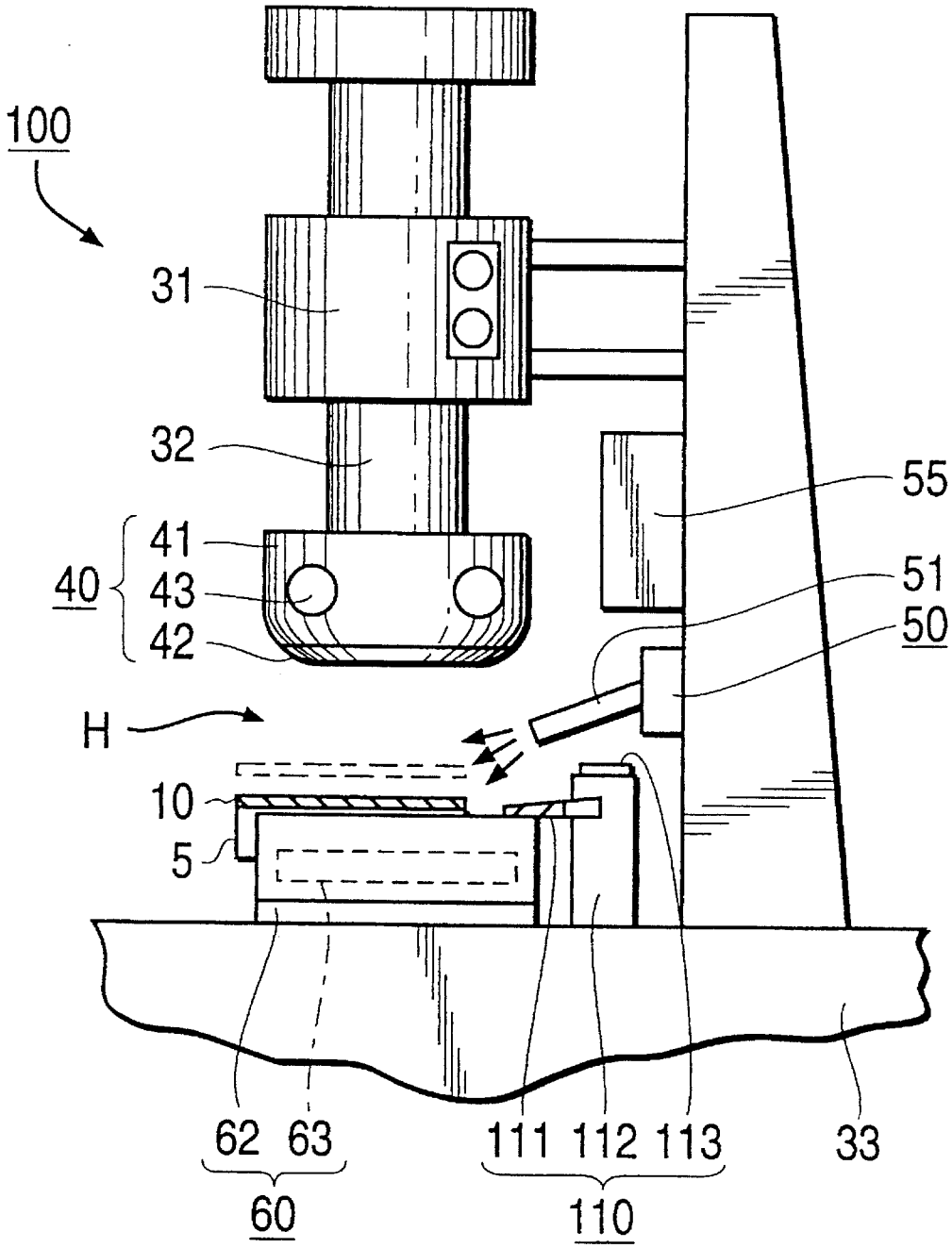
FIG. 18 is a side view showing a fourth embodiment of a thermal transfer printing device.
Figure 19:
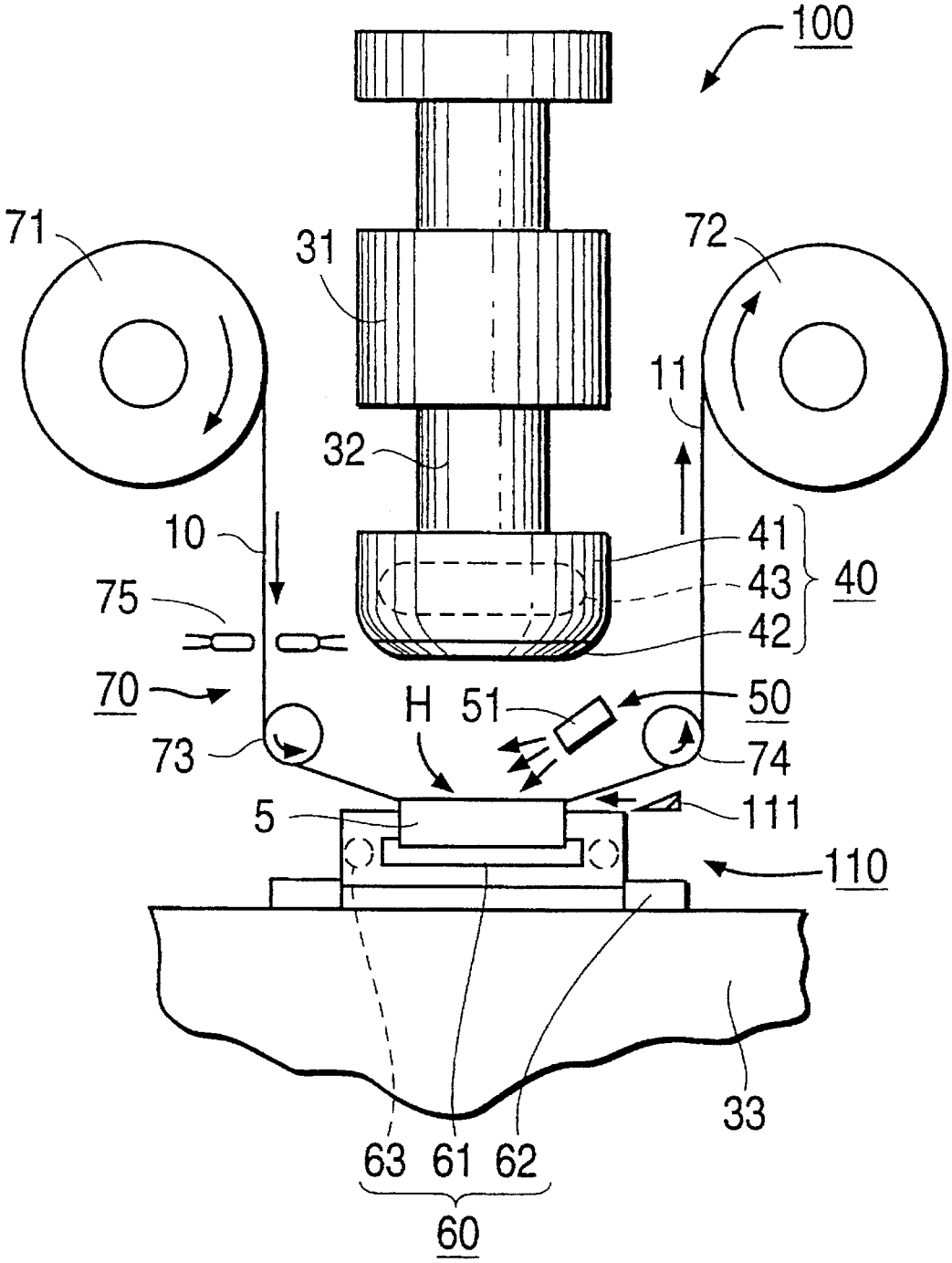
FIG. 19 is a front view showing essential parts of the thermal transfer printing device shown in FIG. 18.

As shown in FIGS. 18 and 19, the thermal transfer printing device 100 has a number of elements in common with the embodiments described above. The same reference numerals have been used in the figures to refer to identify the common elements among the embodiments.

The device 100 includes a thermal transfer film peeling mechanism 110 for peeling off the thermal transfer film 10 away from the shutter member 5. The thermal transfer film peeling mechanism 110 is arranged in the vicinity of the thermal transfer printing position H, and is constituted by a rotating member 112 mounted on a rotary shaft 113 rotationally driven by a driving source (not shown) and a film peeling member 111 having one end secured to the rotating member 112. The rotary shaft 113 is rotationally driven clockwise as shown by arrow in FIG. 20 in synchronism with the upward movement of the thermal transfer head 40 as will be explained subsequently. The film peeling member 111 is arm-shaped and supported on the outer periphery of the rotary member 112 at a height level such that the planar bottom surface of the film peeling member 111 is coplanar with the shutter portion of the shutter member 5 held on the shutter holding member 60.

Figure 20:
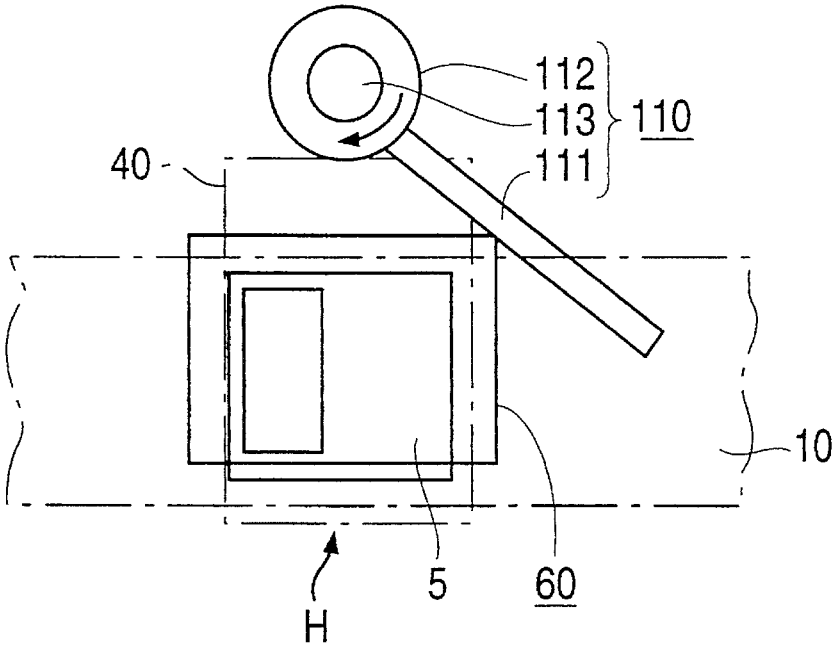
FIG. 20 is a plan view showing essential parts of the thermal transfer printing device shown in FIG. 18.
Figure 21:
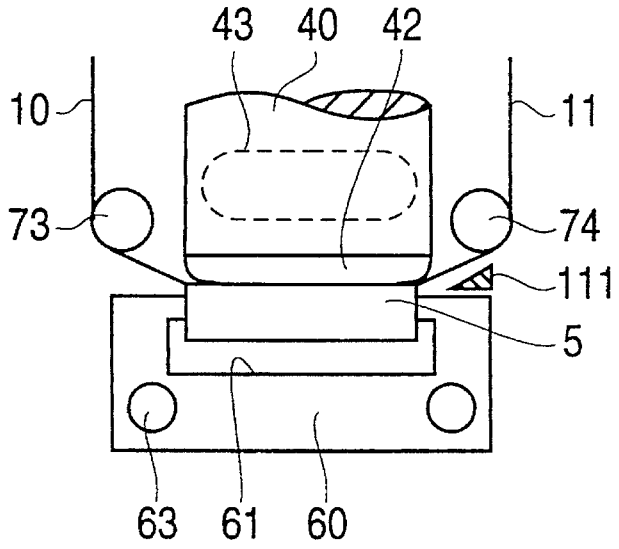
FIG. 21 is a schematic front view illustrating the state in which a thermal transfer film is pressed by a thermal transfer head of the thermal transfer printing device under heating against a shutter portion of a shutter member as a transfer printing article for effecting thermal transfer printing.

The film peeling member 111 has a wedge-shaped cross section such that its thickness is gradually increased from the forward lateral side towards the rear lateral side in FIG. 20 when looking in the rotating direction of the film peeling member 111. Also the film peeling member 111 is protuberantly formed with such a length on the outer peripheral part of the rotating member 112 so that its bottom surface is moved in contact with the entire surface of the shutter portion of the shutter member 5.

Figure 22A:
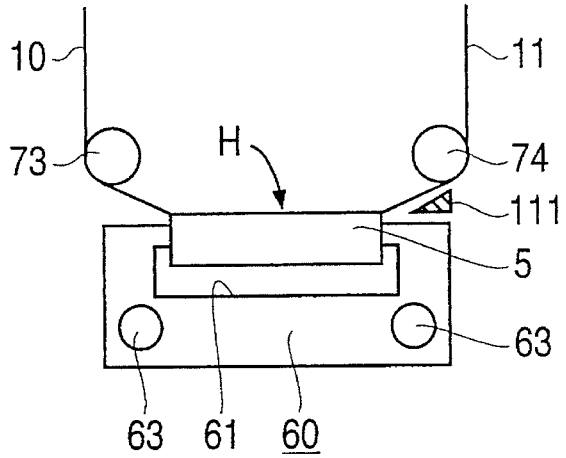

The above-described film peeling member 111 is usually kept in a standby position laterally of the shutter member 5 held by the shutter holding member 60 so as to be interposed between the shutter holding member 60 and the thermal transfer film 10, as shown in FIGS. 20 and 22(A). The film peeling member 111 is moved in sliding contact with the major surface of the shutter portion of the shutter member 5, by rotational driving of the rotary shaft 113, before being reverted to the initial position.

The operation of the thermal transfer film peeling mechanism 110 is initiated after the thermal transfer head 40 is moved upwards and air is blown from the thermal transfer film cooling unit 50 onto the thermal transfer film 10. That is, the rotary shaft 113 of the thermal transfer film peeling mechanism 110 is run in rotation by a driving source (not shown) after the thermal transfer film cooling unit 50 comes into operation. Thus the film peeling member 111 is rotated as it is supported by the rotating member 112 so that the film peeling member is moved from the position shown in FIG. 22(A) in parallel with the major surface of the shutter portion of the shutter member 5 as the film peeling member is introduced into a space between the thermal transfer film 10 and the shutter member 5 held by the shutter holding member 60.

Figure 22B:
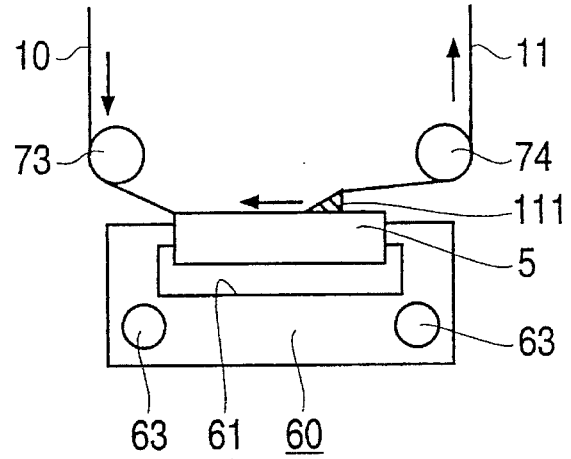

The wedge-shaped cross-section of the film peeling member 111 is increased in thickness along the direction of rotation thereof, so that the film peeling member is moved in sliding contact with the major surface of the shutter portion of the shutter member 5 as it peels the base film 11 of the thermal transfer film 10 from the peeling layer 12, as shown in FIG. 22(B). The thermal transfer film supply guide mechanism 70 is actuated with a small time lag with respect to the rotation of the film peeling member 111. The operation of the thermal transfer film supply guide mechanism 70, that is, intermittent rotation of the supply reel 71 and the take-up reel 72, is halted by the marking 15 of the thermal transfer film 10 being read by the positioning sensor 75. Thus a pre-set length of the thermal transfer film 10 is supplied to the thermal transfer printing position H, while the base film 11, peeled from the shutter member 5, is taken up by the take-up reel 12.

Figure 22C:
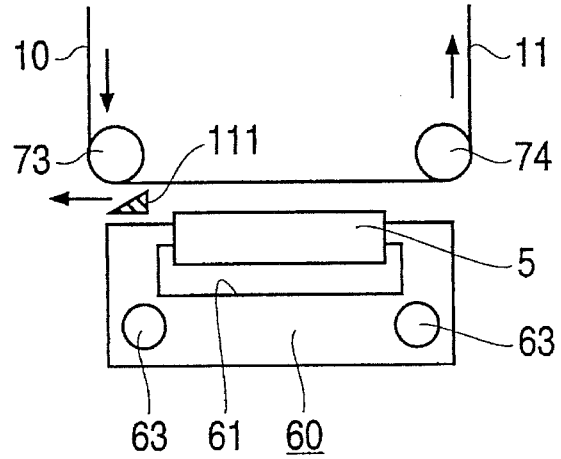

The base film 11 of the thermal transfer film 10 is progressively peeled via a release layer 12 from the shutter portion of the shutter member 5 by the film peeling member 111 which is moved in translation relative to the shutter member 5 from its one lateral side to its opposite lateral side. Thus the base film 11 may be peeled off from the shutter member 5 with a smaller peeling force as shown in FIG. 22(C). The printing layer 13 and the protective layer 12, carrying the letter 6 or the picture pattern 7, may be transferred and printed in an extremely satisfactory state by the hardened heat sensitive adhesive layer 14 being securely bonded to the shutter portion of the shutter member 5, without the layers 13, 14 being peeled off partially along with the base film 11. Thus the multi-color letter 6 and the picture pattern 7 are printed on the shutter portion of the shutter member 5.

The thermal transfer film peeling mechanism 110 peels the base film 11 from the shutter portion with a smaller peeling force by relative parallel movement between the film peeling member 111 and the shutter member 5. Thus, with the present thermal transfer printing device 100, the base film 11 may be peeled from the printing surface in a satisfactory state without producing deformation even if the transfer printing article is a metal printing member of a reduced film thickness, other than the shutter member 5, having a larger printing area.

It suffices to hold the base film 11 in a taut state with the base film having been peeled from the shutter portion of the shutter member 5 by the film peeling member 111. It is unnecessary to uplift the base film 11 to an elevated position relative to the printing surface. Thus, with the present thermal transfer printing device 100, it is unnecessary to load the thermal transfer film 10 with a running tension and to utilize a portion of the tension as the peeling force, as in the case of other thermal transfer printing devices. Thus it becomes possible to lower the tension of the running system of the thermal transfer film 10 and to set the facing distance between the thermal transfer film 40 and the shutter member 5 to a smaller value for reducing the size of the device or increasing the operating speed of the device.

The base film 11, thus peeled from the shutter portion of the shutter member 5, is held taut between the thermal transfer film guide members 73, 74 without sagging towards the shutter member 5, as shown in FIG. 22(C), since the running tension is applied to the thermal transfer film 10 by the operation of the thermal transfer film guide mechanism 70. After the base film 11 is peeled from the shutter portion of the shutter member 5 as described above, the rotating member 112 is rotated further, and is halted at the initial position of the film peeling member 111.

The shutter holding member 60 is then moved away from the thermal transfer printing position H by movement of the transfer driving mechanism. The shutter member 5, on the shutter portion of which the letter 6 or the picture pattern 7 has been printed by multicolor printing by the thermal transfer film 10, is taken out at the transport position from the shutter holding member 60 to complete a thermal transfer printing cycle.

With the above-described fourth embodiment of the thermal transfer printing device 100, the shutter member 5 is loaded and held on the shutter holding member 60 and automatic thermal transfer printing is effectuated on the shutter member 5 which is transported along a transporting channel. However, the present invention is not limited to such thermal transfer printing device 100 and may be modified as in a fifth embodiment which will now be explained.

Figure 23:
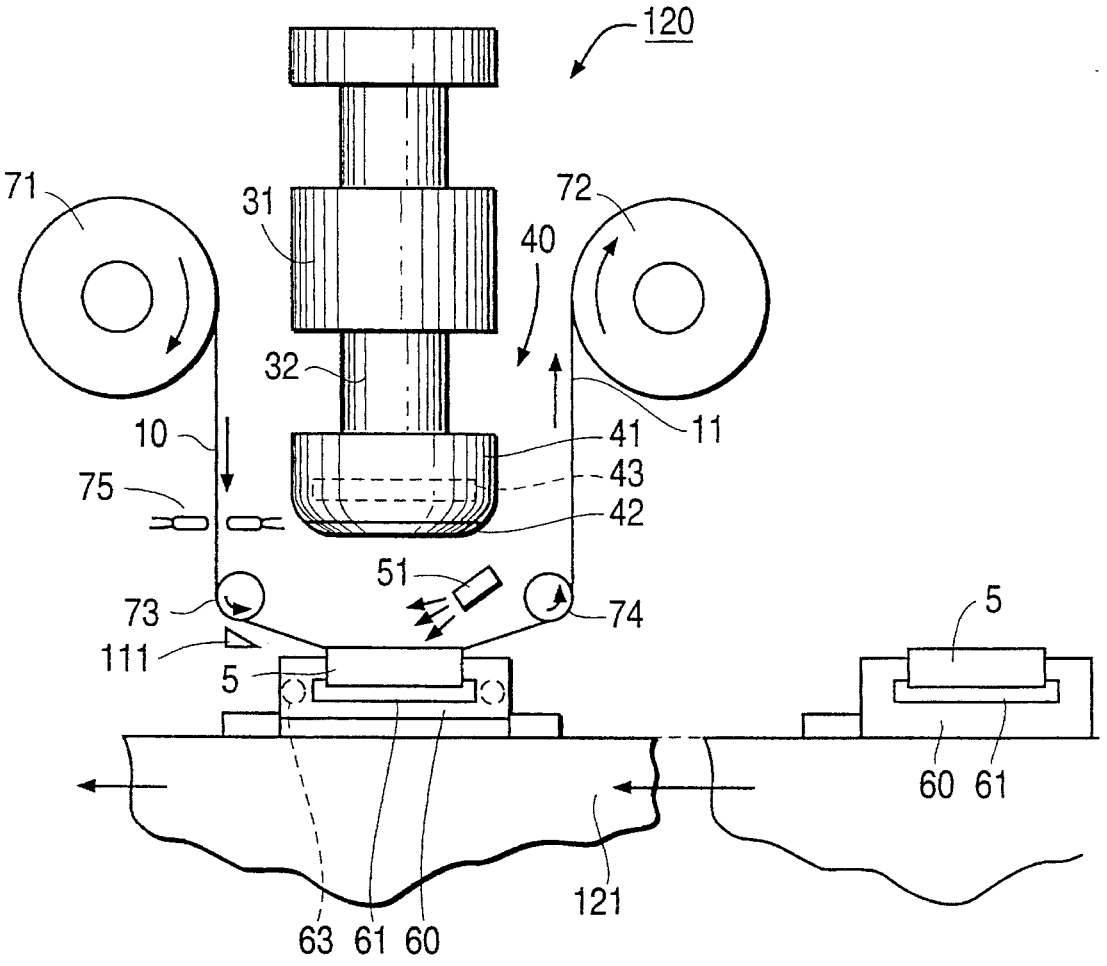
FIG. 23 is a side view showing a thermal transfer printing device for continuous multicolor thermal transfer printing according to a fifth embodiment of the present invention.
Figure 24:
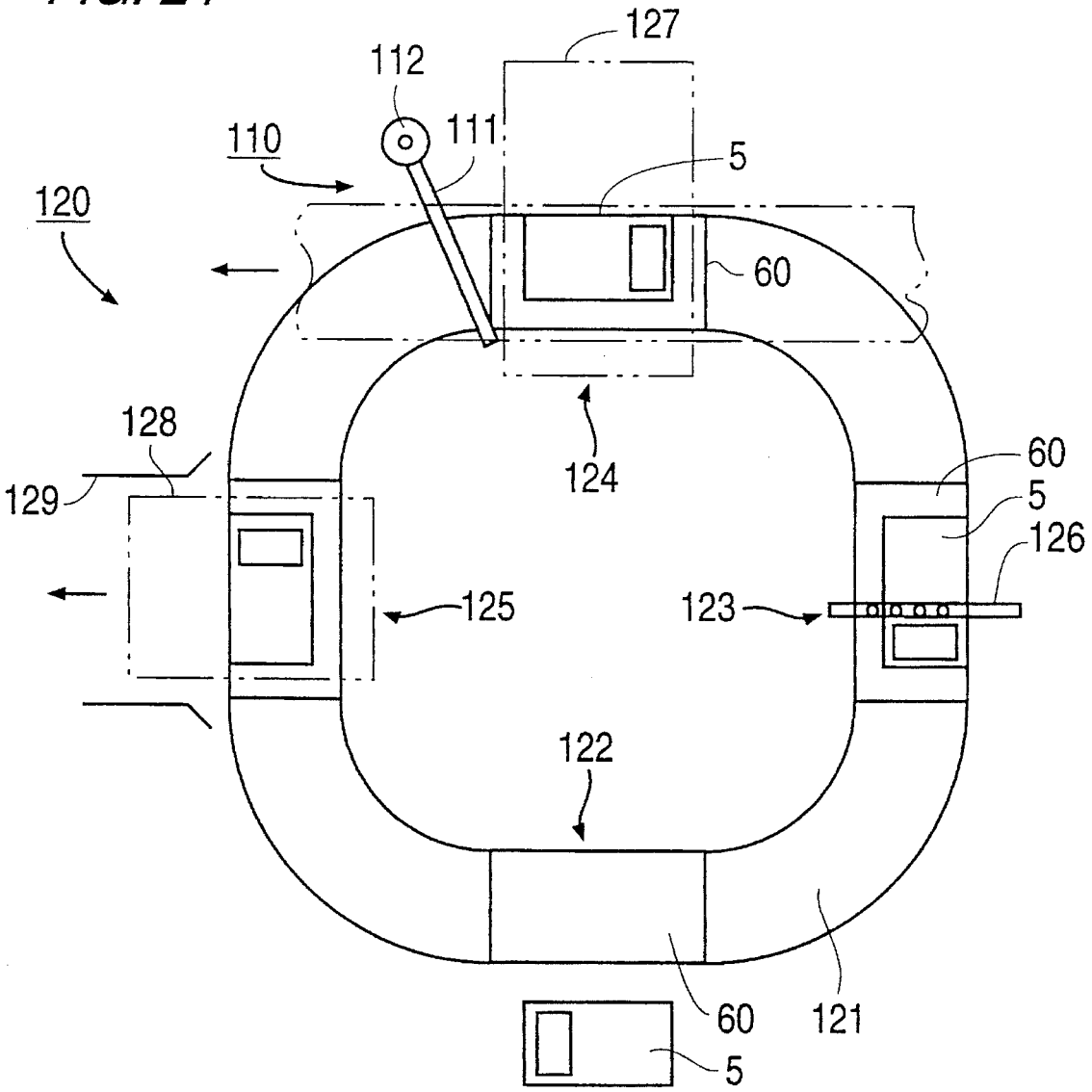
FIG. 24 is a plan view showing essential parts of the thermal transfer printing device shown in FIG. 23.

Referring to FIGS. 23 and 24, there is shown a thermal transfer printing device 120 according to the fifth embodiment in which plural shutter holding members 60 are arranged on a transporting channel 121 formed on a circumference of a rotary table in order to perform continuous thermal transfer printing on shutter members. Although the shutter holding members 60 are shown in FIG. 24 in connection with four representative operating steps for convenience of explanation, five or more shutter members may naturally be provided within the scope of the present invention.

Referring to FIG. 24, the thermal transfer printing device 120 has, as main working steps, a shutter member loading step 122 for loading the shutter members 6 on the shutter holding members 60 along the transport channel 121, a cleaning step 123 for removing dust and dirt affixed on the printing surfaces of the shutter members 5, a thermal transfer printing step 124 for thermal transfer printing on the shutter members 5, and a shutter member takeout step 125 for taking out the shutter member 5 from the shutter holding members 60.

At the shutter member loading step, each shutter member 5, on the shutter portion of which thermal transfer printing is to be made, is loaded on the shutter holding member 60 so that the shutter portion to be printed will lie on the upper surface of the shutter holding member 60 and the opposite shutter portion is inserted into the hollow portion 61 of the shutter holding member 60. The shutter holding member 60, thus holding the shutter member 5, is transported to the cleaning step 123.

At the cleaning step 123, an air blowout member 126 is provided above the transporting channel 121 of the shutter holding member 60. When the shutter holding member 60 is being transported, the air blowout member 126 blows out air via peripheral blowout ports onto the shutter portion of the shutter member 5. Thus the shutter member 5 is freed of the dust and dirt affixed on the surface of the shutter portion thereof and is transported in this state to the thermal transfer printing step 124. If the shutter member 5 is transported in a clean state from the previous step, there is naturally no necessity of providing the cleaning step 123.

The thermal transfer printing step 124 has a main member of a thermal transfer printing device 127, as shown in FIG. 23. The main member of the thermal transfer printing device 127 is substantially the same in constitution as the thermal transfer printing device 100 of the above-described fourth embodiment. Thus the same or similar components are correspondingly numbered and the description therefor is not made for simplicity. It should be noted that the printing device 127 could also be in the form of the printing devices 30, 80, or 90 according to the other embodiments described above.

The thermal transfer film peeling mechanism 110 is arranged on the downstream side of the transporting channel 121 since the thermal transfer film 10 is fed in the same direction as the transporting direction of the shutter member 5. Thus the film peeling member 111 of the thermal transfer film peeling mechanism 110 is rotated as it is interposed between the thermal transfer film 10 and the shutter member 5 for peeling the base film 11 from the shutter member 5 via the release layer 12.

After the pre-set letter 6 or picture pattern 7 has been multi-color thermal transfer printed on the major surface of the shutter portion of the shutter member 5, the shutter member 5 is transported to the shutter member takeout step 125 as it is held on the shutter holding member 60. The shutter member takeout step 125 has a chuck unit 128 the construction of which is customary and hence is not explained in detail. The chuck unit 128 takes out the thermal transfer printed shutter member 5 from the shutter holding member 60 and feeds it onto a takeout channel 129. The shutter member 5 may be taken out from the shutter holding member 60 by an operator instead of by the chuck unit 128. The shutter member takeout step 125 may naturally be placed at the same position as the shutter member loading step 122.

With the above-described fifth embodiment of the thermal transfer printing device 120, the pre-set letter or character 6 or the picture pattern 7 may be continuously thermal transfer printed on the shutter members 5 using the thermal film 10. The thermal transfer printed shutter member 5 has the letter or character 6 or the picture pattern 7 printed thereon in an extremely satisfactory state since the base film of the thermal transfer film 10 is peeled off with a smaller peeling force by the operation of the film peeling member 111.

The above-described thermal transfer printing devices 100 and 120 are arranged so that the film peeling member 111 is supported by the rotating member 112 and is moved parallel to the shutter portion of the shutter member 5 by the rotation of the rotary shaft 113 for peeling the base film 11 of the thermal transfer film 10 from the shutter member 5.

Figure 25:
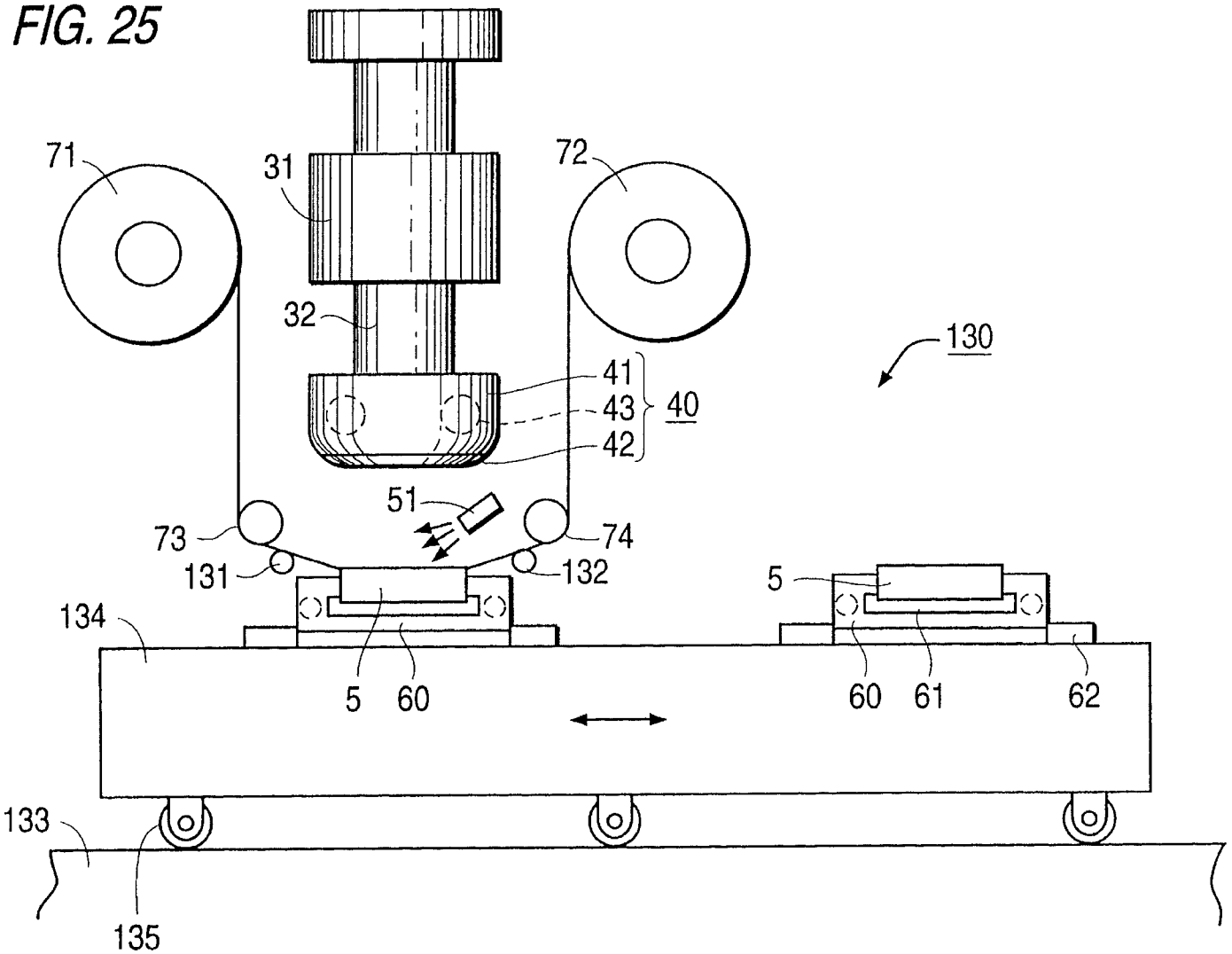
FIG. 25 is a side view showing essential parts of a thermal transfer printing device for multicolor thermal transfer printing according to a sixth embodiment of the present invention, with the film peeling member being of a fixed type.
Figure 26:
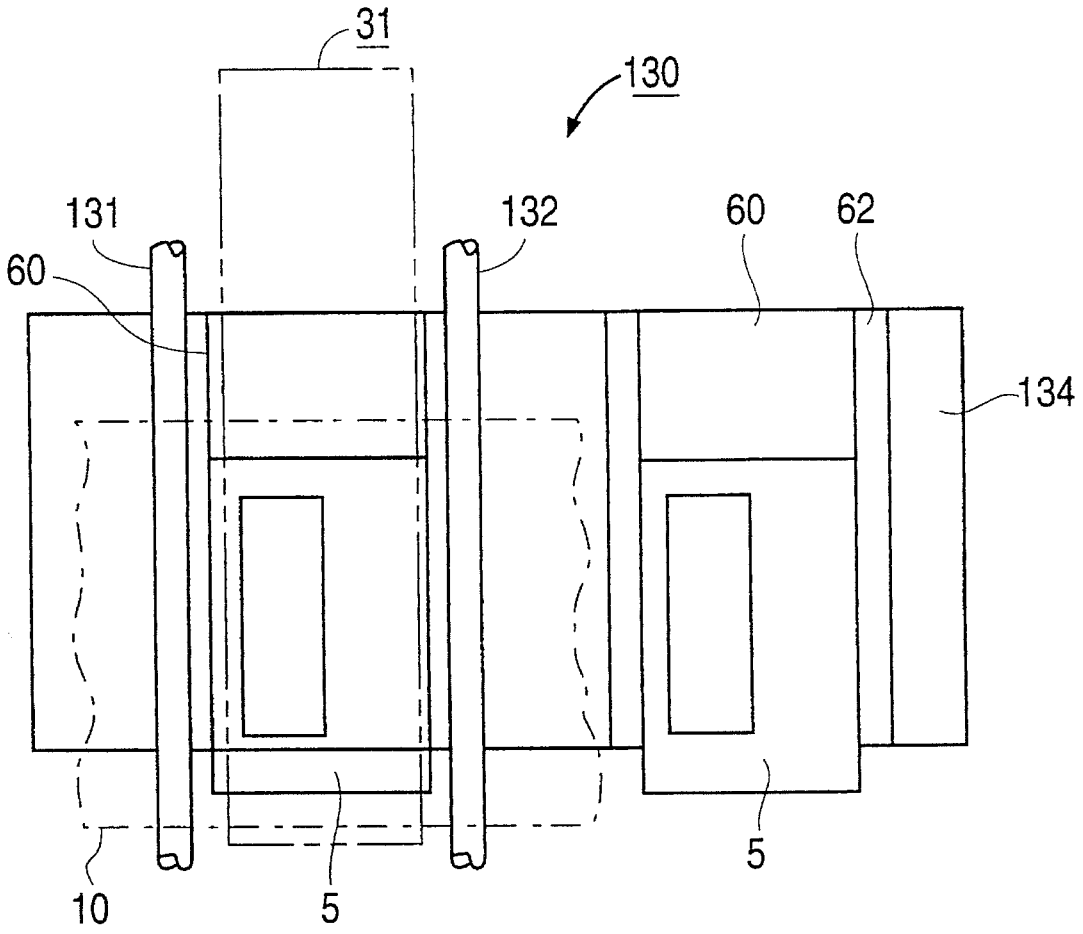
FIG. 26 is a plan view showing essential parts of the thermal transfer printing device shown in FIG. 25.

A thermal transfer printing device 130 according to a sixth embodiment of the present invention includes fixed film peeling members 131, 132, as shown in FIGS. 25 and 26. The thermal transfer printing device 130 of the sixth embodiment has the construction of the main portions of the thermal transfer printing device inclusive of the thermal transfer head 40 similar to the construction of the previous embodiments excluding a transporting member 134 for the shutter holding members 60 and the first and second film peeling members 131, 132. Consequently, the similar parts and components are correspondingly numbered and are not further explained for simplicity.

The transporting member 134 is constituted by a block-shaped member and has castors 135 on its bottom surface for movement along a transporting guide provided on a base member 133. On the transporting member 134 are mounted plural shutter holding members 60 via a heat insulating sheet 62, as shown in FIG. 25.

The transporting member 134 is moved in the left-and-right direction in FIG. 25 at a pre-set constant pitch in a timed relation to the lifting movement of the thermal transfer head 40 by a driving source (not shown). Thus, with the arrangement of FIG. 25 in which two shutter members 60 are arranged on the transporting member 134, thermal transfer printing may be performed continuously if the shutter member 5 is mounted on or dismounted from one of the shutter holding members 60 when the other shutter holding member 60 is positioned below the thermal transfer head 40.

The first and second film peeling members 131, 132 are arranged at a thermal transfer printing position for facing the transporting channel 121 for the shutter member 5. The first and second film peeling members 131, 132 are carried by supporting members so that the height position of the first and second film peeling members is slightly higher than the printing surface, that is the shutter portion of the shutter member 5 held by the shutter holding member 60. The first and second film peeling members 131, 132 are arranged on both sides of the transport channel 121 in close adjacency to both lateral sides of the shutter holding member 60 located at the thermal transfer printing position, as shown in FIG. 26.

Although the first and second film peeling members 131, 132 are shown as round rods, they may also be constituted similarly to the film peeling member 111 of the thermal transfer film peeling mechanism 110 of the thermal transfer printing device 100 of the fourth embodiment, that is, the film peeling members 131, 132 may have a wedge-shaped cross section and be arranged with the pointed edges thereof facing each other.

With the above-described sixth embodiment of the thermal transfer printing device 130, the thermal transfer head 40 is lowered towards the shutter member 5 in the thermal transfer printing position by the operation of the thermal transfer head driving unit 31 for pressing the thermal transfer film 10 against the shutter portion as the printing surface under heating for melting the heat sensitive adhesive layer 14. After lapse of a pre-set time, the thermal transfer head 40 is reset to its initial position by the operation of the thermal transfer head driving mechanism 31. The thermal transfer film 10, having its heat sensitive adhesive layer 14 melted by abutting contact with the thermal transfer head 40, is caused to adhere to the shutter portion of the shutter member 5 by air blown through the nozzle 51 of the thermal transfer film cooling unit 50 for curing the heat sensitive adhesive layer 14, with the thermal transfer head 40 having been reset to the initial position.

After curing the heat sensitive adhesive layer 14 of the thermal transfer film 10 by the operation of the thermal transfer film cooling device 50, with the thermal transfer head 40 having been reset to the initial position, the transporting member 134 is moved towards the left in FIG. 25 by a driving device. The shutter holding member 60 arranged on the transporting member 134 is moved away from the thermal transfer printing position, with the shutter member 5 held thereon. This causes the first film peeling member 131 to be introduced into a space between the shutter member 5 and the heat sensitive film 10 affixed to the shutter member 5.

The first film peeling member 131, thus introduced into the space between the shutter member 5 and the heat sensitive film 10, is moved parallel to the major surface of the shutter portion, with movement of the shutter member 5, for efficiently peeling the base film 11 of the thermal transfer film 10 from the peeling layer 12. The operation of the thermal transfer film supply guide mechanism 70, that is, the intermittent rotation of the supply reel 71 and the take-up reel 72, occurs with a slight time lag relative to the movement of the transporting member 104 for taking up the base film 11 peeled from the shutter member 5.

The base film 11 of the thermal transfer film 10 is gradually peeled off from the shutter member via the release layer 12 by the operation of the first film peeling member 131 with movement of the shutter member 5. Thus the base film 11 may be peeled off with a smaller peeling force from the shutter member 5. By the cured heat sensitive adhesive layer 14 being securely affixed to the shutter portion of the shutter member 5, the printing layer 13 and the protective layer 12, carrying the letter 6 or the picture pattern 7, may be transfer printed in an extremely satisfactory condition without becoming partially peeled along with the base film 11. This allows multi-color printing of the letter 6 and the picture pattern 7 to be printed on the shutter portion of the shutter member 5.

When the transporting member 134 is moved towards the right in FIG. 25, the second film peeling member 132 is introduced into the space between the shutter member 5 and the heat sensitive film 10 affixed to the shutter portion thereof for peeling off the base film 11. The operation of the film peeling member 132 is otherwise the same as the above-described film peeling member 131 and hence is not described in further detail.

The fixed type film peeling members 131, 132 provided on the thermal transfer printing device 130 of the present sixth embodiment may be used in place of the thermal transfer film peeling mechanism 110 and rotary film peeling member 111 in the thermal transfer printing device 120.

With the above-described thermal transfer printing according to the present invention, the thermal transfer film is superimposed on and pressed against the pre-heated transfer printing article under heating in order to effect thermal transfer printing. After cooling the thermal transfer film, the film peeling member is moved parallel to the transfer printing article for peeling the base film of the thermal transfer film from the major surface of the thermal printing article. This prohibits heat dissipation from the thermal printing article and allows the heat sensitive adhesive layer of the thermal transfer film to be melted and cured in a shorter time to effect transfer printing of the printing layer of the thermal transfer film on the transfer printing article in an extremely short time. Since the base film may be peeled under a smaller peeling force, the transfer printing article may be prevented from being deformed and transfer printing may be made on a larger printing area in a satisfactory condition.

Also, with the thermal transfer printing according to the present invention, a smaller clearance between the transfer printing article and the base film peeled from the thermal transfer printing article suffices, while there is no necessity of enlarging the take-up tension for the base film, that is the thermal transfer film, for preventing the base film from becoming slacked. In addition, with the thermal transfer printing according to the present invention, it becomes possible to shorten the working time since the small distance suffices between the film peeling member or the thermal transfer head and the transfer printing article, while it becomes possible to shorten the curing time for the heat sensitive adhesive layer and hence the time involved in the thermal transfer printing process in its entirety.

On the other hand, with the thermal transfer printing device according to the present invention, means for pre-heating the transfer printing article is provided in the thermal printing article holding mechanism and, after pressing the thermal transfer film superimposed on the thermal printing article on the transfer printing article by the thermal transfer head under heating, the film peeling member is moved parallel and relative to the transfer printing article, while cooling the thermal transfer film by cooling means for peeling the base film of the thermal transfer film from the major surface of the transfer printing article. Since the small distance suffices between the film peeling member or the thermal transfer head and the transfer printing article, it becomes possible to shorten the working time as well as the curing time for the heat sensitive adhesive layer and hence the time involved in the thermal transfer printing process in its entirety.

In addition, with the thermal transfer printing device according to the present invention, since the small clearance suffices between the base film peeled from the transfer printing article and the transfer printing article, and the base film may be prevented from becoming slacked, the take-up tension of the base film and hence the thermal transfer film may be diminished. On the other hand, the spacing between the thermal transfer printing article and the thermal transfer head may be diminished for shortening the working time and for realizing an automatic continuous printing device.

The thermal transfer printing device of each of the previously explained embodiments is of the type in which the letters 6 indicating the type of the article or the model name or the picture patterns 7 are printed in multiple colors on one of the shutter sections of the metal shutter member 5 of the disc cartridge using the thermal transfer film 10. However, the present invention is not limited to such shutter member 5, but may be employed extensively to a variety of metal or ceramic products having high heat radiating characteristics, such as metal nameplates, casings or electrodes. In such case, the shutter holding member 60 for holding the shutter member 5, that is, the holding mechanism for holding the support for transfer printing, is shaped to hold the support for transfer printing under an optimum holding condition.

With the above-described thermal transfer printing method according to the present invention, the thermal transfer film is applied to the pre-heated support for transfer printing having high heat radiating characteristics, and is pressure bonded under heating onto the support by the thermal transfer head. After the printing is terminated, the thermal transfer film is cooled for preventing heat dissipation from the support, while the heat sensitive adhesive layer of the thermal transfer film is melted and solidified in a shorter time so that the printing layer of the thermal transfer film may be transfer printed in an extremely short time period and under an optimum condition. In addition, since the thermal transfer film alone is detached from the associated side of the support for transfer printing, the thermal transfer film is decreased in its peeling force and the support may be prevented from being deformed, while the transfer printing may be achieved under an optimum condition.

In addition, the above-described thermal transfer printing device includes preliminary heating means provided in the transfer printing support holding unit for pre-heating the support. After the thermal transfer film applied to the support is pressure-bonded under heating onto the support by the thermal transfer head, the thermal transfer film is peeled off from the support as the thermal transfer film is cooled by cooling means, so that the printing layer of the thermal transfer film may be transfer-printed under an extremely satisfactory condition onto the support for achieving transfer printing, while the operating time may be diminished significantly. Furthermore, the thermal transfer film alone is peeled off from one side of the support by the thermal transfer film guide means or the support holding means, with the result that the peeling force of the thermal transfer film is diminished and the support may be prevented from being deformed, while the transfer printing may be achieved under a more satisfactory printing condition.

The illustrated embodiments were chosen and described in order to best explain the principles of the invention and its practical application to thereby enable others skilled in the art to best utilize the invention and various modifications as are suited to the particular use comtemplated. It is intended that the scope of the invention only be limited by the claims appended hereto.

What is claimed is:

1. A thermal transfer printing method for transferring a printing layer from a thermal transfer film onto a metal or ceramic material by a thermal transfer head, the thermal transfer film having a base film, a printing layer and a heat sensitive adhesive layer, both of which layers are formed on the base film, the method comprising the steps of:

(a) heating the material;

(b) shifting the material to a thermal transfer printing position;

(c) pressing the thermal transfer film onto the material with the thermal transfer head;

(d) separating the thermal transfer head away from the thermal transfer film;

(e) cooling the thermal transfer film; and (f) peeling the base film of the thermal transfer film away from the material while leaving the printing layer and adhesive layer on the material.

2. The thermal transfer printing method as claimed in claim 1, wherein, in step (f), the base film of the thermal transfer film is peeled off from one side of the material.

3. The thermal transfer printing method as claimed in claim 1, wherein, in step (f), the base film of the thermal transfer film is peeled off from the material by shifting the thermal transfer film upward and simultaneously shifting a holding member holding said material.

4. The thermal transfer method as claimed in claim 3, wherein the step of shifting the holding member comprises shifting the holding member opposite a take-up direction of the base film.

5. The thermal transfer method as claimed in claim 1, wherein the step of heating the material comprises heating the material while the material is being shifted to the thermal transfer printing position.

6. A thermal transfer printing apparatus for transferring a printing layer from a thermal transfer film onto a material by a thermal transfer head, the thermal transfer film having a base film, a printing layer, and a heat sensitive adhesive layer, both of which layers are formed on the base film, the apparatus comprising:

holding means for holding said material;

a heater for heating said material;

a thermal transfer head for pressing and heating said thermal transfer film for transferring the printing layer onto said material;

means for separating said thermal transfer head from said thermal transfer film;

cooling means for cooling said thermal transfer film;

peeling means for peeling the base film of said thermal transfer film off from the material; and control means for causing said thermal transfer head to press said thermal transfer film onto said material as said material is heated by said heater to transfer said printing layer onto said material, for causing said thermal transfer film to be cooled by said cooling means after separation of said thermal transfer head from said thermal transfer film by said separating means, and for causing said peeling means to peel said base film off from said material.

7. The thermal transfer printing apparatus according to claim 6, wherein said heater is located within said holding means.

8. The thermal transfer apparatus as claimed in claim 6, wherein said peeling means comprises means for peeling the base film of the thermal transfer film off from one side of the material.

* * * * *